US009707138B2

(12) United States Patent
Hsiao-Wecksler et al.

(10) Patent No.: US 9,707,138 B2
(45) Date of Patent: Jul. 18, 2017

(54) GEAR-SHIFTING SYSTEM FOR MANUALLY PROPELLED WHEELCHAIRS

(75) Inventors: Elizabeth T. Hsiao-Wecksler, Urbana, IL (US); Scott Daigle, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 504 days.

(21) Appl. No.: 14/234,799

(22) PCT Filed: Jul. 27, 2012

(86) PCT No.: PCT/US2012/048598

§ 371 (c)(1),
(2), (4) Date: Apr. 23, 2014

(87) PCT Pub. No.: WO2013/016655

PCT Pub. Date: Jan. 31, 2013

(65) Prior Publication Data

US 2014/0232085 A1 Aug. 21, 2014

Related U.S. Application Data

(60) Provisional application No. 61/512,276, filed on Jul. 27, 2011.

(51) Int. Cl.

| | |
|---|---|
| ***A61G 5/02*** | (2006.01) |
| ***A61G 5/04*** | (2013.01) |
| ***A61G 5/10*** | (2006.01) |

(52) U.S. Cl.

CPC ..... *A61G 5/021* (2013.01); *A61G 5/02* (2013.01); *A61G 5/022* (2013.01); *A61G 5/023* (2013.01);

(Continued)

(58) Field of Classification Search

CPC .. B62B 1/00; A61G 2005/00; A61G 2005/08; A61G 2005/10; A61G 2005/128;

(Continued)

(56) References Cited

U.S. PATENT DOCUMENTS 2,956,443 A * 10/1960 Nelson ..... B62M 11/14 192/217.4
3,563,568 A * 2/1971 Sasse ..... A61G 5/02 280/230

(Continued)

FOREIGN PATENT DOCUMENTS

DE 4211338 A1 * 10/1993 ..... A61G 5/02
WO WO 2004-016496 2/2004

OTHER PUBLICATIONS

IntelliWheels Wheelchair Technologies, Mar. 5, 2010, https://netfiles.uiuc.edu/sdaigle2/www/intelliwheels.html.

(Continued)

*Primary Examiner* — Joseph Rocca
*Assistant Examiner* — Daniel Yeagley
(74) *Attorney, Agent, or Firm* — Greer, Burns & Crain, Ltd.; Steven P. Fallon

(57) ABSTRACT

Apparatus for a manually-powered wheelchair comprising a frame and first and second wheel rotatably coupled to the frame. Each wheel includes a hand rim and a drive wheel. For each of the first and second wheels, a multiple speed transmission coupled to the wheel comprises a transmission output coupled to the drive wheel, a transmission input coupled to the hand rim, and at least two gears selectively coupling the transmission output to the transmission input. The transmission allows the drive wheel and the hand rim to rotate concentrically with one another but at different speeds. A selector is provided for selecting one of the at least (Continued)

two gears. A controller controls the selector to operate the transmission for the first and/or second wheel.

14 Claims, 22 Drawing Sheets

(52) U.S. Cl.
CPC ..... *A61G 5/024* (2013.01); *A61G 5/045* (2013.01); *A61G 5/048* (2016.11); *A61G 5/1054* (2016.11); *A61G 2203/20* (2013.01); *A61G 2203/32* (2013.01); *A61G 2203/36* (2013.01); *A61G 2203/38* (2013.01); *A61G 2203/42* (2013.01)

(58) Field of Classification Search
CPC .. A61G 2005/1054; A61G 5/02; A61G 5/021; A61G 5/022; A61G 5/024
See application file for complete search history.

(56) References Cited

U.S. PATENT DOCUMENTS 5,362,081 A * 11/1994 Beidler ..... A61G 5/02 280/236
5,482,305 A * 1/1996 Jeffries ..... A61G 5/023 280/250.1
6,047,980 A * 4/2000 Margherita ..... A61G 5/026 280/248
6,805,371 B2 10/2004 Meginniss, III et al.
2003/0057673 A1* 3/2003 Fowles ..... A61G 5/02 280/252
2005/0229731 A1* 10/2005 Parks ..... B62M 11/06 74/122
2006/0124366 A1 6/2006 De Chermont
2006/0197302 A1* 9/2006 Meginniss ..... A61G 5/02 280/250.1
2008/0029992 A1 2/2008 Lindsay et al.
2008/0039270 A1 2/2008 Smithson et al.
2008/0073869 A1* 3/2008 Patterson ..... A61G 5/023 280/244
2008/0238022 A1 10/2008 Kylstra et al.
2008/0252036 A1 10/2008 Smurthwaite
2009/0166995 A1* 7/2009 Sorquist ..... A61G 5/023 280/249
2010/0062884 A1* 3/2010 Tay ..... F16H 9/08 474/25
2010/0131164 A1* 5/2010 Carter ..... B60L 11/1805 701/61
2010/0160109 A1 6/2010 Su et al.
2010/0264620 A1 10/2010 Miles et al.

OTHER PUBLICATIONS

The News-Gazette, Don Dodson, "UI student's wheelchair features rolling, with changes", Nov. 30, 2009, http://www.news-gazette.com/news/education/2009-11-30/ui-students-wheelchair-features-rolling-changes.html.
TEC News | Technology Entrepreneur Center, Danyelle Michelini, "Scott Daigle Innovates Wheelchair Transportation", Nov. 9, 2009, http://illinois.edu/lb/article/1442/31675.
Wijit, "Wheelchair Driving and Braking System", www.wijit.com, Date Uncertain—Possible 2011 or Earlier.
Magic Wheels, Date Uncertain as Early as 2011.
E-motion M15 Date Uncertain as Early as 2011.

* cited by examiner

GEAR-SHIFTING SYSTEM FOR MANUALLY PROPELLED WHEELCHAIRS

PRIORITY CLAIM AND REFERENCE TO RELATED APPLICATION

This application claims the benefit of U.S. Provisional Application Ser. No. 61/512,276, filed Jul. 27, 2011.

FIELD OF THE INVENTION

A field of the invention is medical devices.

BACKGROUND OF THE INVENTION

There are an estimated 1.5 million manual wheelchair users (mWCUs) in the United States, and an estimated 200 million wheelchair users worldwide. Manual wheelchair users depend on their upper limbs for mobility and activities of daily living. However, up to 70% of manual wheelchair users report shoulder pain. Shoulder pain in mWCUs has been directly linked to further disability including difficulty performing activities of daily living, decreased physical activity, and reduced quality of life. Overall, any loss of upper limb function due to pain adversely impacts the independence and mobility of mWCUs. Thus, it is imperative to provide innovative technologies, therapies, and interventions to minimize shoulder pain.

Using a powered wheelchair takes away all strain on the shoulders and reduces shoulder pain. However, powered chairs are not a viable option for most wheelchair users, because they are expensive, heavy (i.e., too heavy to load into a car, requiring special vans and lifts), have limited use duration due to battery life, require frequent recharging, provide little flexibility for persons who are capable of manually propelling their own chair, are sometimes too wide to fit through doorways, and contribute to reduced physical fitness due to limited upper body movement. Additionally, there is often a negative stigma attached to the use of these devices among manual wheelchair users.

In order to address this large segment of the community that experiences difficulty pushing a wheelchair, various designs have been provided in the art. Examples include power assist wheelchairs, lever operated wheelchairs, and manually gear shifting wheelchairs. Push-rim activated power assist wheelchairs (PAPAWs) were one of the first technologies that addressed this need. They are similar to power wheelchairs, but batteries and motors in the wheel hubs assist the user to push his/her chair. These devices have been shown to significantly reduce the amount of energy used by an mWCU. However, PAPAWs are not ideal since they are heavy (e.g., 53 lbs of added weight) and more difficult to maneuver than a manual wheelchair, as they require two large electric motors and a battery. Also, the range of such devices is limited before the battery needs recharged. Further, these devices are quite expensive, e.g., more than an entry level powered chair, and the price does not include the cost of a wheelchair frame.

Lever operated wheelchairs are an innovative way to utilize a more ergonomic rowing motion from the wheelchair user. An example lever operated wheelchair is provided in an add-on device from Wijit Wheelchairs (Roseville, Calif.). Evaluation of these devices has shown that levers are a more comfortable method of propulsion, and they reduce the amount of work from the shoulders. However, these devices do not follow the concept of a traditional wheelchair design; that is, use of hand rims. Such wheelchairs accordingly require a relatively high learning curve to switch between forward and reverse propulsion. With an unintuitive method for current manual wheelchair users of braking and pushing in reverse, these devices have not had wide acceptance.

Magic Wheels (Seattle, Wash.) created a two-speed wheelchair add-on system in which the second gear is specifically catered for going uphill. In a clinical trial using this device, subjects experienced a significant reduction in the severity of shoulder pain. However, a limitation is that the user has to stop and manually shift into the other gear, e.g., physically turn a dial on the side of the wheel to shift. For many wheelchair users who have limited dexterity in their hands (e.g., due to spinal cord injury), it is physically impossible to turn this dial. Further, users have to be cognizant of when to shift, and thus individuals with cognitive deficits such as traumatic brain injury, dementia, etc., are unable to utilize such a device.

SUMMARY OF THE INVENTION

An embodiment provides, among other things, an apparatus for a manually-powered wheelchair. The wheelchair comprises a frame and first and second wheels rotatably coupled to the frame. Each wheel includes a hand rim and a drive wheel. For each of the first and second wheels, a multiple speed transmission coupled to the wheel comprises a transmission output coupled to the drive wheel, a transmission input coupled to the hand rim, and at least two gears selectively coupling the transmission output to the transmission input. The transmission allows the drive wheel and the hand rim to rotate concentrically with one another but at different speeds. The at least two gears are taken from the group consisting of one or more over-drive gears, one or more under-drive gears, and a direct drive gear directly coupling the transmission input and the transmission output to one another. A selector is provided for selecting one of the at least two gears. A controller controls the selector to operate the transmission for the first and/or second wheel.

DETAILED DESCRIPTION

Figure 1:
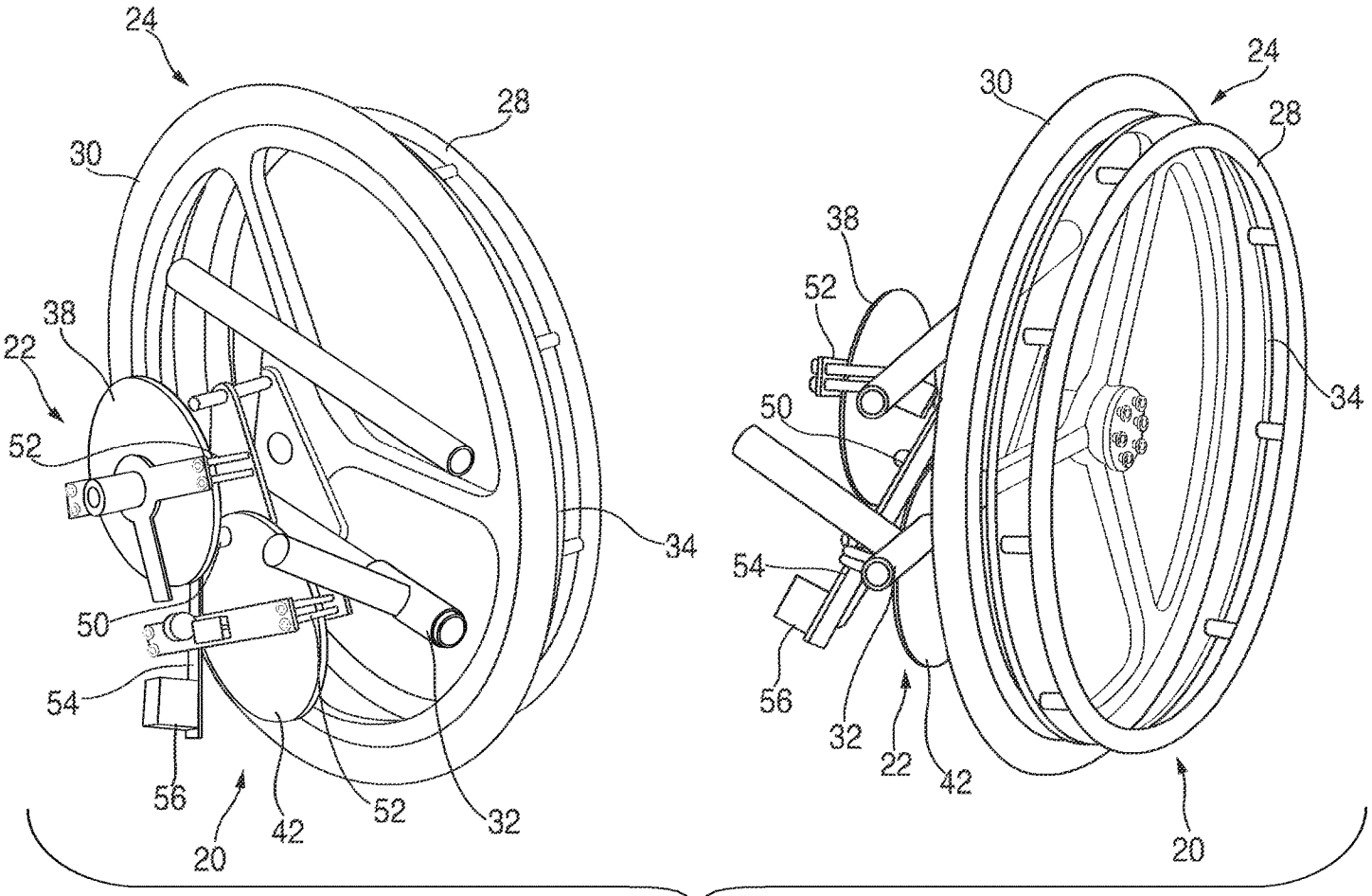
FIG. 1 shows rear and front perspective views of an example portion of a manual wheelchair including a wheel incorporating a continuous variable transmission (CVT) according to an embodiment, with a frame of the wheelchair cut away and components of the transmission removed for clarity.

Example embodiments of the present invention provide, among other things, an automatic transmission that adds on to or is otherwise incorporated into manual wheelchairs. As opposed to standard manual wheelchairs having one gear, an example embodiment provides an automatic multi-speed (e.g., at least two speeds) transmission or gear shifting system for manually propelled wheelchairs, and wheelchairs including such a system. Using automatic gear changes to facilitate propulsion provides a paradigm shift in the way that manual wheelchairs can be used.

An embodiment provides, among other things, an apparatus for a manually-powered wheelchair, and a manually-powered wheelchair having such an apparatus. "Manually-powered" is intended to refer to a wheelchair being provided with power for motion at least partially through user exertion (e.g., by a user pushing the hand rims to rotate them), and it is preferred, though not required, that movement of the wheelchair is powered for motion mainly or entirely through user exertion.

The wheelchair includes a frame and first and second wheels rotatably coupled to the frame. "First" and "second" are not intended to indicate a particular order, but are used for clarity of description, and each can refer to either the left or right wheel. The apparatus includes an automatic, multiple speed transmission coupled to the wheel for each of the first and second wheels. Multiple speed or multi-speed can refer to any number of speeds, or gears, greater than one. Automatic refers to a selection of a particular speed or gear that occurs at least in part without user action.

In an example embodiment, the transmission is located in the wheel hub for the first and second wheels, respectively. However, other arrangements are possible, such as locating the transmission under the seat of the wheelchair or elsewhere. Further, in an example embodiment, the first and second wheels can be provided as part of an add-on system for a wheelchair (including but not limited to an existing wheelchair), though this is not required in every embodiment. An add-on system can further include a quick release locking mechanism for coupling the first and second wheels with integrated transmissions to the frame of the wheelchair.

For each wheel, the automatic, multiple speed transmission includes a transmission output coupled to a drive wheel, and a transmission input coupled to a hand rim of the wheel such that the drive wheel and the hand rim rotate concentrically with one another but can rotate at different speeds. A transmission output generally refers to a component of the transmission that rotates at an output (drive) rotational speed of the transmission, such as the speed determined by selecting a particular gear. A transmission input generally refers to a component of the transmission that rotates at an input rotational speed of the transmission, such as but not limited to the speed of a user's rotation of the hand rim. The transmission output can be coupled to the drive wheel directly or indirectly and the transmission output can be coupled to the hand rim directly or indirectly.

In an example embodiment, the transmission can further include at least two gears coupling (directly or indirectly) the transmission output to the transmission input. These at least two gears can include any gears selected from: one or more over-drive (or high) gears; one or more under-drive (or low) gears; and a direct-drive gear directly coupling the transmission input and the transmission output to one another. Here, directly coupling generally refers to a coupling that allows the transmission input and the transmission output to be rotatable at the same speed via the directly coupled gear (i.e., a 1:1 gear ratio) and can include a single component or intermediate components. It is not required that the at least two gears include a particular type of gear—the selected gears could omit any of under-drive gears, direct-drive gear, or over-drive gears if desired.

A selector is provided for selectively coupling the transmission input to the transmission output via one of the at least two gears. Generally, the selector is any device or mechanism that allows this selective coupling. The selector can engage the gears in any of various methods. In an example embodiment, the selector includes a shifting assembly for shifting gears, a pinion for selectively shifting the shifting assembly, and a shifter rod for selectively moving the pinion. The shifter rod can be moved using an actuator.

In another embodiment, a continuously-variable transmission (CVT) can be provided, coupled (directly or indirectly) to the transmission output and the transmission input, for selectively coupling the transmission output and the transmission input. A CVT is similar to a normal transmission, but it has an infinite number of gear ratios within a certain range to allow the transmission can shift smoothly under load. A selector can be provided for shifting the continuously variable transmission.

To control a selector and thus control the transmission, a controller (which can be embodied in an individual controller or multiple controllers) is provided for controlling the selector of the first and/or second wheel. The controller can be coupled to a frame of the wheelchair, or located elsewhere. In an example embodiment, one or more sensors are coupled to the first and/or second wheels to sense position of the continuously-variable transmission, and/or speed and/or torque of the wheel and the controller is configured to receive signals from the one or more sensors and process these signals to control the selector by controlling the actuator. Other sensors that may be provided include but are not limited to tilt sensors.

In an example embodiment, the transmission output is embodied in a portion of a housing for the transmission that provides or fits within a hub for the wheel. This housing, for instance; can house the transmission input, the at least two gears, the shifter assembly, and the selector, though not all of these need be in the housing.

In an example embodiment, a user interface is provided. This user interface can be coupled to the controller. A nonlimiting example user interface includes indicia for displaying a current gear to a user, and can include other information, such as speed, exertion, tilt, and many others.

In an example embodiment, the user interface also includes at least one selectively operable control for overriding operation of the controller and manual gear selectors for allowing a user to manually select the transmission gear.

The automatic transmission can be embodied in an example add-on system, which includes a set of wheels housing the transmission and onboard electronics including the controller. This example system can be added to an existing wheelchair frame (or a customized wheelchair frame). Example add-on systems can provide a wheelchair that is more efficient than a manual wheelchair, but less expensive than a power wheelchair. In example operation, the user simply pushes the wheelchair as though it was a conventional wheelchair, and the example system intelligently selects the best gear. Wheelchairs incorporating example systems are also provided. Preferably, and similar to most manual wheelchairs, the wheels for the example system, with the incorporated transmission(s), can be quickly detached from the wheelchair without the use of tools, e.g., via the quick release locking mechanism. This makes it easier to load the wheelchair into a vehicle, for instance.

In operation, the wheelchair user still pushes the hand rims forward, backward, and in opposite directions in order to turn; however, the hand rims drive the multi-speed transmissions (e.g., located in each wheel hub), which in turn drive the drive wheels. In low gear, this reduces the amount of force required from the wheelchair user, which has the potential to reduce the severity and incidence of shoulder pain. While travelling at high speeds in high gear, the user pushes less often and in a more ergonomic way.

Preferred embodiments will now be discussed with respect to the drawings. The drawings include schematic figures that are not to scale, which will be fully understood by skilled artisans with reference to the accompanying description. Features may be exaggerated for purposes of illustration. From the preferred embodiments, artisans will recognize additional features and broader aspects of the invention.

FIG. 1 shows an example apparatus 20 for a manual wheelchair. The apparatus 20 employs a continuously-variable transmission (CVT) 22 coupled to each of first and second wheels 24. The example CVT 22 coupled to each wheel 24 can be identical (though this is not required in every embodiment), and accordingly for clarity of description analogous parts for the wheels 24 and the CVT are identified with like reference characters. For each of the wheels 24, the CVT 22 respectively couples a hand rim 28 of the wheel to a drive wheel 30 such that the hand rim and the drive wheel rotate concentrically with one another but can rotate at different respective speeds.

The standard manual wheelchair uses a person's arms to push hand rims that turn the drive wheels. In essence, the human user is the motor, and the drive wheels and hand rims are the drive train. Each of the user's hands drives one of two wheels, so there are two drive trains, which allows for forward and reverse movement as well as turning. A wheelchair fitted with the example apparatus 20 preferably takes the same or similar ergonomic design of a conventional wheelchair, but the CVT 22 in each drive train allows for an infinite number of gear ratios to connect the hand rims 28 to the drive wheels 30. When using a higher gear, it takes more torque to push the hand rims, but each push moves the chair farther forward. When using a lower gear, it takes less torque to push the hand rims, but each push doesn't move the user as far forward. For comparison, a standard wheelchair only has one gear.

Figure 2:
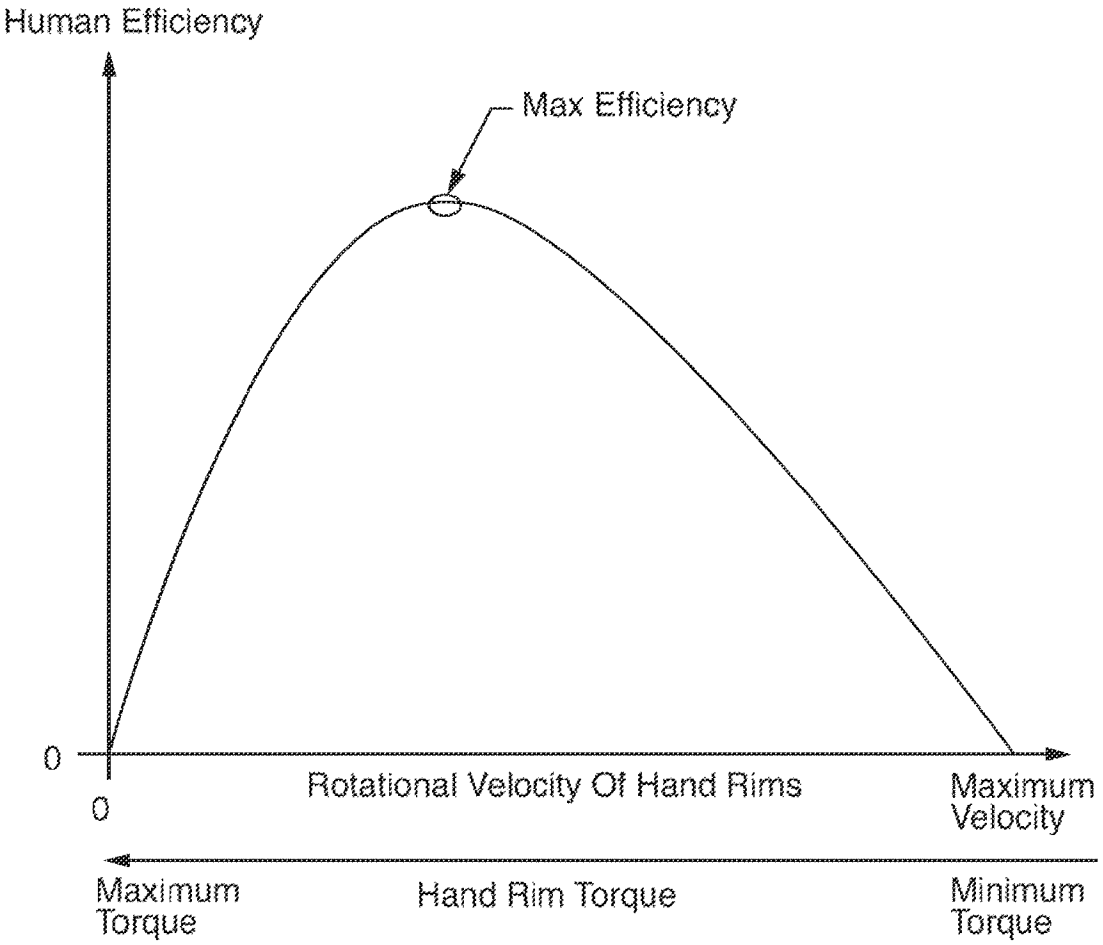
FIG. 2 shows an efficiency curve for a human turning hand rims and a CVT transmission.

By making use of gear ratios in the drive trains, an example embodiment allows the user to operate at a higher efficiency. The user can output more mechanical power to turn the wheels with a smaller amount of effort, which can be measured as the rate of volume of oxygen consumption ($VO_2$ usage). This is because a human, like any motor, has an operating condition that is the highest efficiency. This can be seen qualitatively in FIG. 2. In an example wheelchair the CVT 22 trades rotational velocity of hand rims for torque provided by the user. Since the CVT 22 is continuously variable, it can theoretically give the user an optimal operating condition for peak efficiency at any speed of the wheelchair. A normal wheelchair with no gearing, on the other hand, requires the user to operate at lower efficiencies when moving at low speeds, high speeds, and up hills. By maximizing efficiency, an embodiment lets the wheelchair user consume less $VO_2$ to move at a certain speed on a certain grade, as with a bicycle. A lower amount of exertion may also decrease shoulder pain, which is a common complaint among everyday users of standard manual wheelchairs. An example embodiment provides large benefits to a user while operating at low speeds, high speeds, and on sloped ground.

Referring to FIGS. 1 and 3-5, the CVTs 22 are incorporated into a manual wheelchair. A nonlimiting example wheelchair is an Invacare Tracer EX Lightweight Wheelchair. It will be understood, however, that example embodiments of the invention could be configured or adapted to fit nearly any manual wheelchair. In this example embodiment the CVTs 22 are located on a (e.g., aluminum) frame 32 of the wheelchair (most of the frame is cut away in FIG. 1), on the inside of the chair under the seat so that the overall width is not increased. An example embodiment uses aluminum from quarter inch thick aluminum plates for weight and durability.

Unlike conventional wheelchair designs, the hand rim 28 is preferably not connected directly to the drive wheel 30. Instead, the hand rim 28 and the drive wheel 30 both rotate about the same axis, but they rotate on separate axles. Particularly, the example hand rim 28 is fixedly coupled (e.g., mounted) to a rotatable Plexiglas circle 34 that is in turn fixedly coupled to a hand rim shaft 36 rotatable about an axis that passes through a center of the Plexiglas circle. The hand rim shaft 36 is fixedly coupled to a rotatable hand rim cone 38, such that rotation of the hand rim 28 directly rotates the hand rim shaft 36 and thus directly rotates the hand rim cone 38. An example hand rim cone 38 is aluminum for strength and weight reduction, though other materials are possible.

The drive wheel 30, rotating concentrically with the hand rim 28, is coupled to a chain drive (not shown), which couples the drive wheel to a drive wheel shaft 40. In turn, the drive wheel shaft 40 is fixedly coupled to a (e.g., aluminum) drive wheel cone 42, such that rotation of the drive wheel cone directly drives rotation of the drive wheel 30. In this way, the hand rim 28 and the drive wheel 30 rotate concentrically, but rotate about separate axels and can rotate at different speeds. Turning the hand rims 28 turns the hand rim cone 38 directly, so that the hand rim cone 38 provides a transmission input for the CVT 22. Similarly, turning the drive wheel cone 42 turns the drive wheel 30 directly, so that the drive wheel cone provides a transmission output for the CVT 22. Conical bearings 44 are provided (FIG. 4) for rotation of the hand rim cone 38 and the drive wheel cone 42. The hand rim shaft 36 and the drive wheel shaft are disposed within ball bearings 46 for rotation.

The example CVT 22 further includes a (for example, urethane) roller 50 disposed in between the hand rim cone 38 and the drive wheel cone 42. This roller 50 allows shifting of a gear ratio and controlling respective rotation of the hand rim cone 38 and the drive wheel cone 42 by contact of the cones at selected locations. Because the drive wheel 30 rests on the drive wheel shaft 40 with ball bearings 46 it can rotate freely with respect to the hand rim shaft 36 (e.g., at a different speed). The hand rim shaft 36 turns the hand rim cone 38 in the CVT 22. This hand rim cone 38 turns the roller 50, which drives the drive wheel cone 42. In turn, the drive wheel cone 42 turns the drive wheel shaft 40, which powers the drive wheel 30 through the chain drive. Since the drive wheel 30 is able to rotate at a different speed from the hand rim 28, different gear ratios can be provided.

Figure 3:
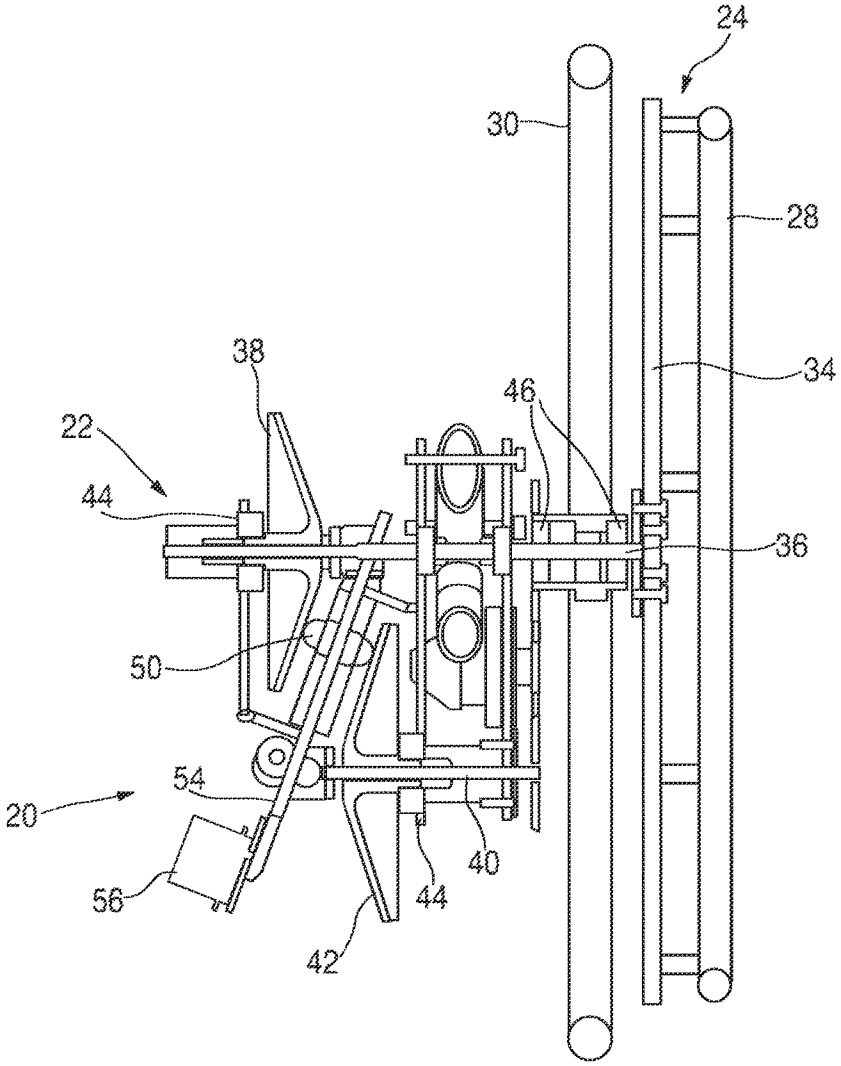
FIG. 3 is a side cutaway view of the CVT of FIG. 1.
Figure 4:
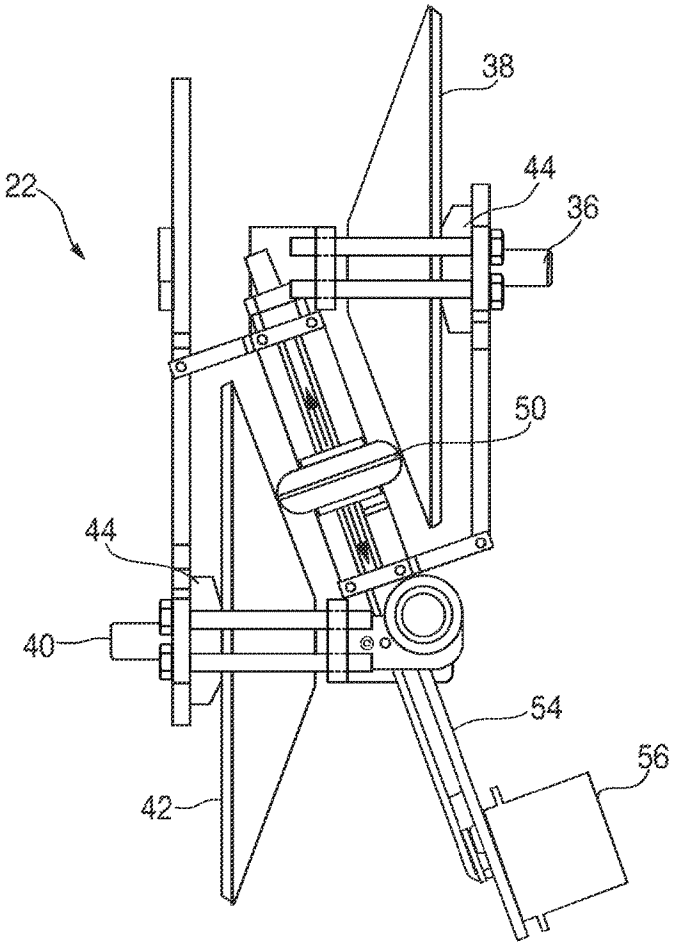
FIG. 4 shows a larger cutaway view of the CVT of FIG. 1.
Figure 5:
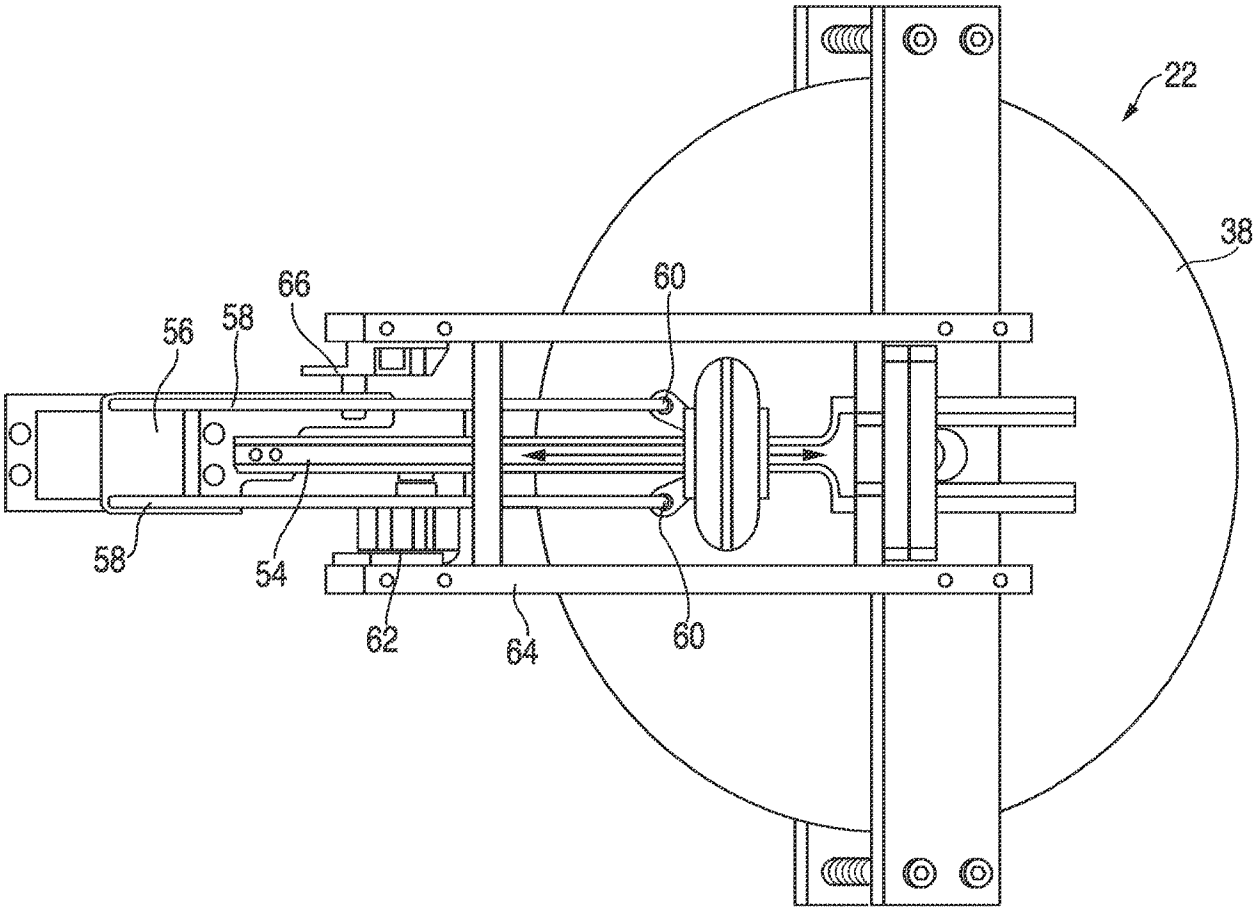
FIG. 5 is a side cutaway view of the CVT of FIG. 1.

FIG. 4 shows a larger cutaway view of the CVT 22 shown in FIG. 3, and illustrates how different gear ratios are achieved. Changing a position of the roller 50 with respect to surfaces of the drive wheel cone 42 and the hand rim cone 38 changes the gear ratio. The example CVT 22 relies on a rolling friction interface between the cones 38, 42 and the roller 50, and as such the amount of friction is preferably calibrated. To accomplish this, bolts 52 can be tightened to push the cones harder on the roller and increase friction. The conical bearings 44 both center the cones 38, 42 on their respective axes and provide the thrust force needed for adequate friction.

To shift between gears, the example CVT 22 uses chair movement to make the roller 50 translate in a given direction. Changing gear ratios is achieved by selectively changing the roller 50 angle. If the cones 38, 42 are rotating, a sliding assembly 54, best shown in FIG. 5, will be driven left or right. An actuator embodied (for example) in a servo 56 is provided to control the angle of the roller 50 through two connecting rods 58 hingedly coupled to two points 60 of the roller. A nonlimiting example servo is a GWServo S03T STD. The roller 50 and the servo 56 provide a selector for shifting the CVT 22.

The servo 56 can control position of the roller 50 between −5 and 5 degrees in a nonlimiting example design. When the roller 50 is not at a zero angle, the sliding assembly 54 will be driven along the cones 38, 42 radially. A rotary encoder 62, for instance a US Digital S4-360-125-D-D rotary encoder, is turned by a set of rack and pinion gears 64 disposed on the sliding assembly 54 in order to sense position. Since the rotary encoder is not absolute, an optical interrupt 66 is also provided in order to home to the zero position upon initialization. The sensors, including the rotary encoder 62 and the optical interrupt 66, are provided for the CVT 22 in each wheel 24.

A controller (not shown) is provided for operating the CVT 22 for both the first and second wheels 24. The controller is coupled using suitable signal couplings (e.g., leads) to the servo 56, the rotary encoder 62, and the optical encoder 66, as well as to other sensors such as but not limited to a tilt sensor (not shown) and an accelerometer (not shown) for receiving and/or transmitting signals as appropriate. A chip, e.g., LSI/CSI LS7266R1, can be provided to read the encoders 66 and other sensors. A nonlimiting example controller is a Texas Instruments MSP430F2272 microcontroller. Power to the controller and other components is provided in an example embodiment by a power conditioner, for instance a Texas Instruments TLV1117-33CDCYR power conditioner. This example microcontroller is powered by 4 AA batteries, but in other embodiments rechargeable batteries can be used. Further, in an example embodiment such rechargeable batteries can be recharged by small generators on the drive wheels 30. In this way, the example system 20 will not have to be plugged in nor have its batteries changed.

The correct gear ratio is selected by the controller based on velocity of the drive wheels 30 sensed by two additional rotary encoders (not shown), and the tilt of the whole wheelchair is sensed by an accelerometer (not shown). A nonlimiting example accelerometer is a SCA610 Series Accelerometer manufactured by VTI Technologies. This example accelerometer is specifically instrumented to be used as an inclinometer. It puts out an analog signal proportional to its tilt, and it can sense a range of ±5 g. In an example operation, to filter out the bumps and other noise in the accelerometer, a simple running average of 10 digitally sampled data points is taken over the course of one second. Nonlimiting example rotary encoders used for velocity sensing are US Digital model E4P-360-250-D-H-T-B. The quadrature output signals of these example devices are read in a nonlimiting example by LSI/CSI LS7266R1 24-Bit Dual-Axis Quadrature Counters.

In an example apparatus 20, a higher gear ratio is defined as when the hand rims 28 are spinning more slowly than the drive wheels 30. The gear ratio, GR, is calculated by the microcontroller as $$GR=\alpha+K_{\omega 2}\omega^2+K_{\omega 1}abs(\omega)-K_{\theta 2}\theta_C^2-K_{\theta 1}\theta_c-K_{T2}T_C^2K_{T1}T_c$$

where $\alpha$, $K_{\omega 2}$, $K_{\omega 1}$, $K_{\theta 2}$, $K_{\theta 1}$, $K_{T2}$, and $K_{T1}$ are constants, $\omega$ is the rotational velocity, $T_C$ is the torque on the hand rims 28, and $\theta_c$ is the tilt of the chair. The example constants can be experimentally derived. At higher speeds, a higher gear ratio is chosen. On steeper grades both uphill and downhill, a lower gear ratio is chosen. The desired position of the sliding assembly 54, $x_{desired}$, can be calculated as $$x_{desired}=\frac{56.95(GR-1)}{GR+1}$$

where $x_{desired}$ is the position of the sliding assembly 54 with 0 at the center of both cones 38, 42. This example equation was derived from the geometry of the cones 38, 42. x in a nonlimiting example embodiment can vary between +30 min and −30 mm, which achieves a range of possible gear ratios from 3:1 to 1:3. At x=0, the gear ratio is 1. The angle of the roller 50, $\theta$, can then be chosen as $$\theta=K_\theta(\omega)(x_{desired}-x_{sensed})$$

where $K_\theta$ is a constant. The roller angle is then saturated at −5 degrees. The sensed position of each sliding assembly 54 is read by the rotary encoders 62. The quadrature output of the rotary encoders 62 can be read by the same chips that read the other encoders in an example embodiment. Each transmission 22 preferably is controlled separately by the same microcontroller. Except for momentary delays, each transmission can have the same gear ratio as the other. The controllers, sensors, and actuators in this and other embodiments disclosed herein may be coupled to one another using suitable electrical and/or signal couplings. Sensor couplings may be wired or wireless. An example digital sampling and control frequency is 10 Hz, which is slow compared to most other controllers, but an example system is not required to adjust in, say, milliseconds, so this slow period is acceptable.

Mechanical benefits are realized by allowing the user to propel him/herself at a more efficient operating speed and torque. The CVT 22 allows nearly peak efficiency to be reached at most speeds and inclines. Since the CVTs 22 are continuously variable, gear shifting is fluid, which provides a comfortable and fluid design.

Another embodiment provides an add-on system for a manual wheelchair including a multiple-speed (that is, two or more speed) transmission using discrete gears. An example multiple-speed transmission can attain high efficiencies demanded in human propulsion by relying on gears such as, but not limited to, simple spur gears, which can obtain efficiencies up to 98%. Though example multiple-speed transmissions are somewhat analogous to transmissions for bicycles, existing multiple-speed hubs designed for bicycles are not suited for application to wheelchairs. For example, wheelchair users push forward and backward, while nearly all bicycle hubs transmit torque in only one direction. Furthermore, a wheel on a wheelchair is supported from one side, whereas a wheel on a bicycle is designed to be supported at both ends. Because of this, the axles in bicycle multiple-speed hubs are not large enough to support the shear loads in wheelchair use. An example embodiment provides a transmission in consideration of these concerns.

Additionally, an example multiple speed transmission can be reduced in volume compared to a transmission for a system such as the example CVT-based apparatus 20. In a particular example embodiment, the volume of the transmission can be reduced to fit inside of and/or provide a hub for wheels of a manual wheelchair. This allows, among other benefits, the wheels and built-in transmission to be conveniently removable.

Figure 6:
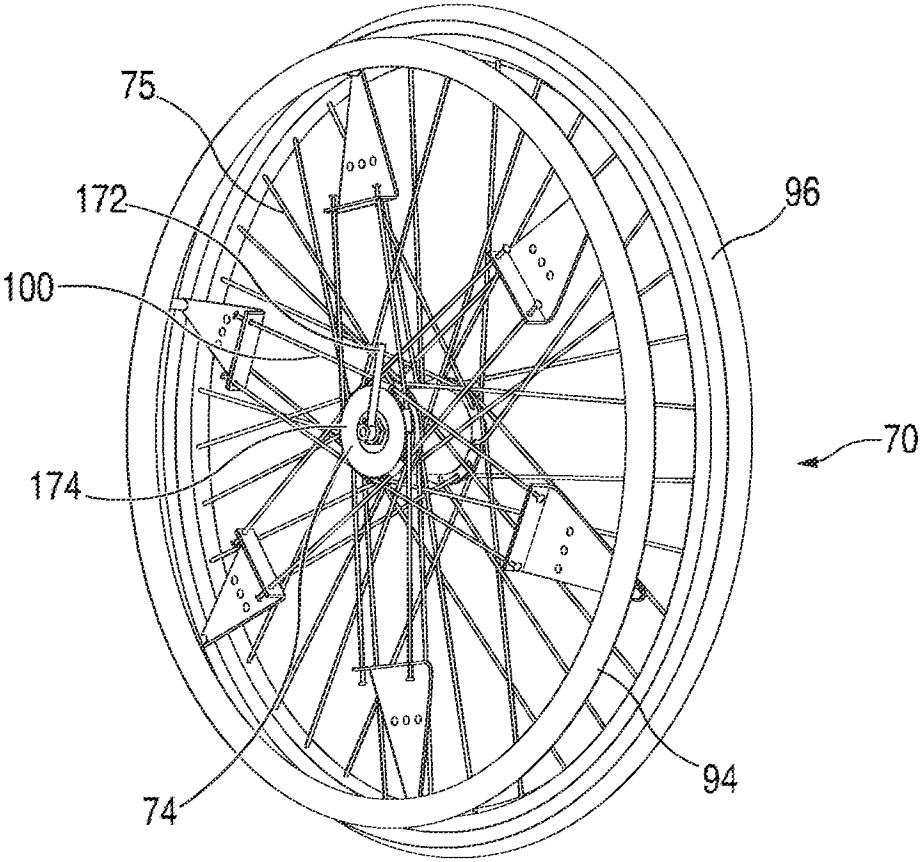
FIG. 6 shows a wheelchair wheel having a transmission integrated in a hub, according to an embodiment.
Figure 7:
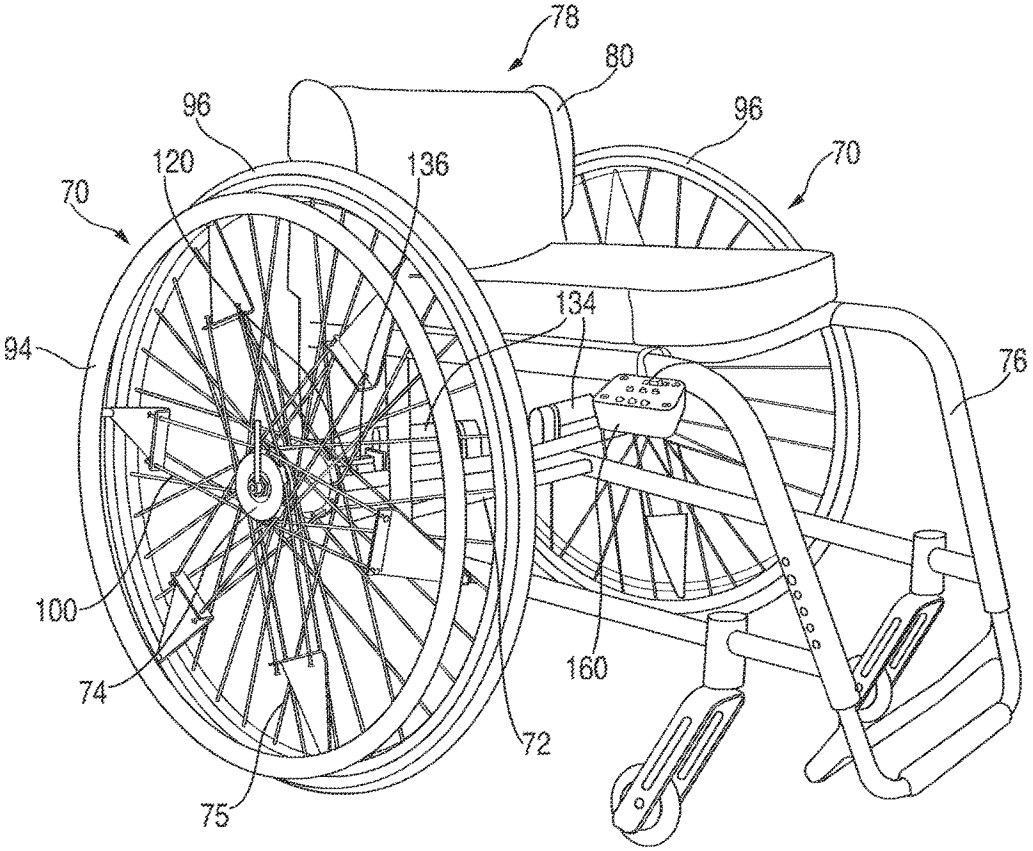
FIG. 7 shows a wheelchair having left and right wheels according to FIG. 6, according to an embodiment.
Figure 8:
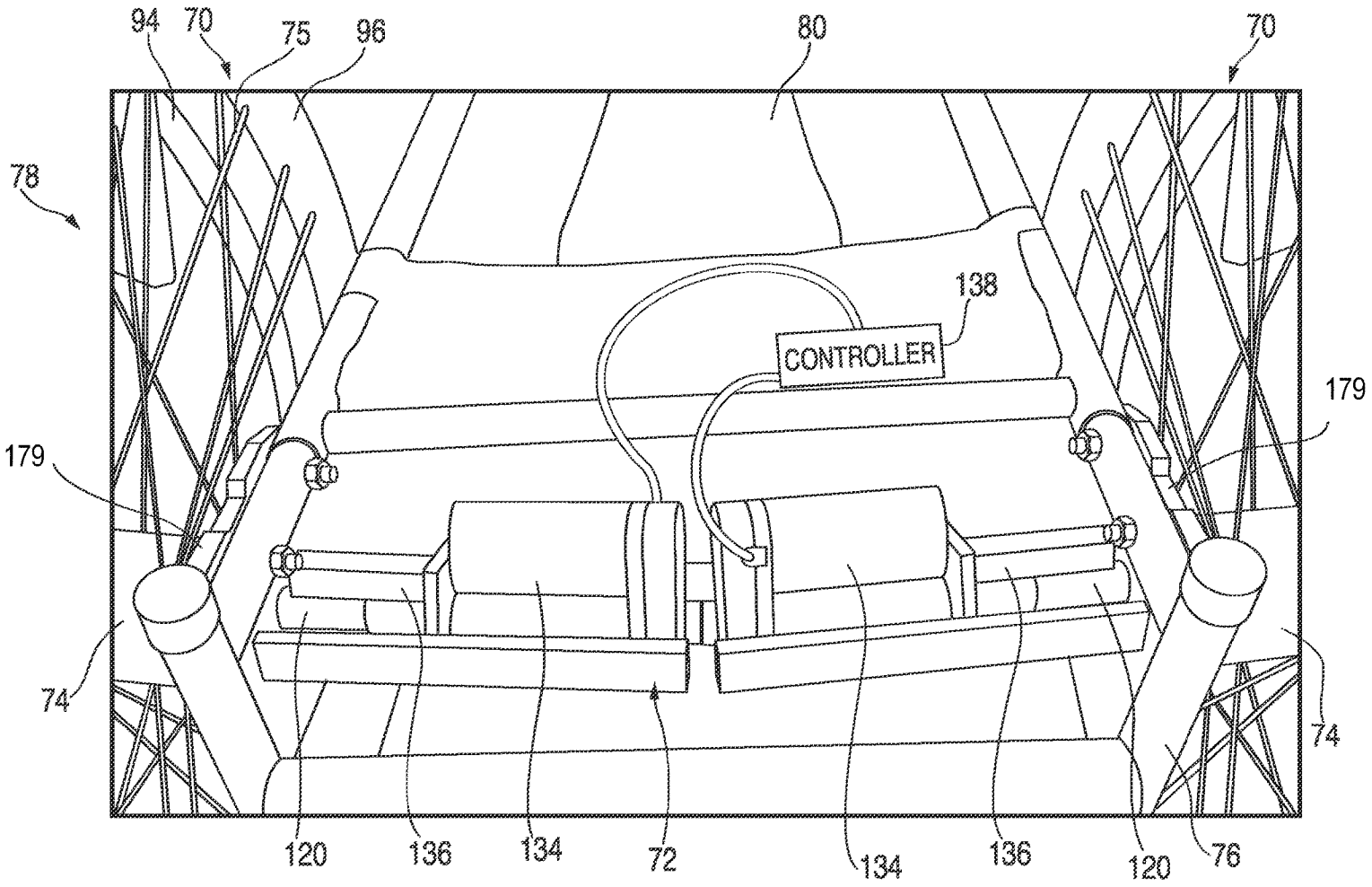
FIG. 8 shows a portion of the wheelchair of FIG. 7 with the seat removed, showing integrated electronics.

Referring to FIGS. 6-8, a nonlimiting example embodiment add-on system includes a set of two wheelchair wheels 70, as well as onboard electronics 72 (best viewed in FIG. 8) for controllably operating a transmission that is integrated into a centrally disposed hub 74 of each wheel. The wheel 70 is coupled to the hub 74 by spokes 75, e.g., steel spokes. The electronics 72 can be added on to a frame 76 of a wheelchair 78, including many conventional wheelchair frames, or added on to a frame that has been modified to support the electronics, as will be appreciated by those of ordinary skill in the art. These electronics 72 can be mounted to the frame 76 in any suitable manner, and can be disposed, as a nonlimiting example, under a seat 80 of the wheelchair 78. A nonlimiting example wheelchair for use with an embodiment is an Invacare Tracer EX Lightweight Wheelchair or a Quicki TI wheelchair. It will be appreciated that an embodiment transmission and electronics can be provided for many suitable manual wheelchairs, including existing or customized wheelchairs, and the particular wheelchair models mentioned herein are for illustration purposes only.

Figure 9A:
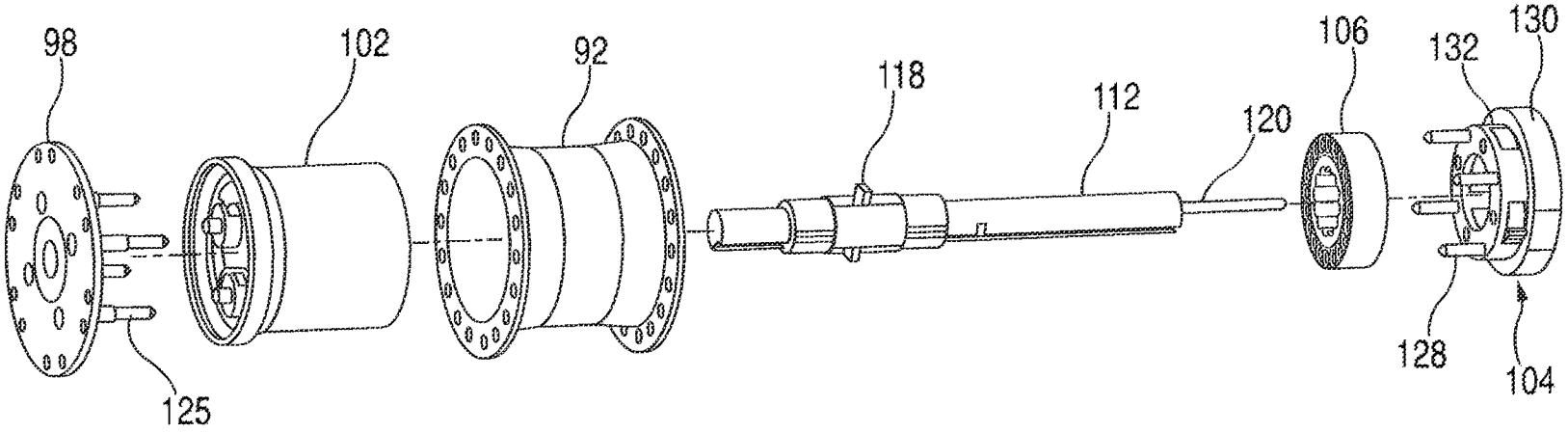
FIG. 9A is an exploded perspective view of a multiple-speed transmission, according to an embodiment.

FIG. 9A is an exploded view of an embodiment multiple speed transmission 90. The transmission 90 can be identical for each of the left and right wheelchair wheels 70. The assembled multiple speed transmission 90 fits inside a housing of the hub 74 embodied in a hub shell 92, which in a nonlimiting example embodiment is about three inches in diameter and about three inches in length. With this small overall size (or other suitably small overall size), the hub 74 can be integrated into the wheelchair wheel 70.

Each wheelchair wheel 70 in an example embodiment can be embodied generally similarly to a conventional manual wheelchair wheel. For example, the wheel's hand rim 94 preferably is slightly smaller in diameter than the drive wheel 96 and is located outside the drive wheel, as with a conventional wheelchair. However, the hand rim 94 is not coupled directly to a rim of the drive wheel 96. Instead, the hand rim 94 is coupled to the transmission 90, which allows the hand rim to spin at a different speed than the drive wheel 96. Particularly, the hand rim 94 is directly coupled (e.g., attached) to a suitable transmission input, such as an input disk 98, with flat (aluminum) spokes 100. A nonlimiting example width of the flat spokes 100 is about one inch wide. The hub shell 92 is directly coupled (e.g., attached) to the wheel rim of the drive wheel 96 with the steel (or other suitable material) spokes 75.

Being "directly" coupled refers to being coupled such that the coupled pieces rotate together, at the same speed (a 1:1 gear ratio), even though there may be intermediate components between the coupled pieces. The hand rim 94 and the input disk 98 are directly coupled to one another, and the drive wheel 96 and the hub shell 92 are directly coupled to one another. By contrast, the hand rim 94 is linked to the drive wheel 96 via the input disk 98 on the transmission hub 74, and is not directly coupled to the drive wheel 96, as opposed to the hand rim and drive wheel of a conventional wheelchair wheel.

The input disk 98 directly coupled to the hand rim 94 provides an example transmission input, and the hub shell 92 directly coupled to the drive wheel 96 provides an example transmission output. In operation, the input disk 98 rotates concentrically with the drive wheel 96 but can rotate independently of the drive wheel (e.g., at a different speed).

In a nonlimiting example embodiment, the multiple-speed transmission 90 is a three-speed transmission. Thus, for illustration only, a three-speed transmission will be particularly described, though it will be appreciated that transmissions of other speeds are possible. The example transmission 90 includes two gear sets, embodied in an over-drive gear set 102 and an under-drive gear set 104. The over-drive gear set 102 and the under-drive gear set 104 can be, as nonlimiting examples, planetary or epicyclic gear sets. Other types of gears that can be used include, but are not limited to, simple gear train, reverted gear train, complex planetary gear sets, etc. Nonlimiting example gear ratios for the over-drive gear set 102 and the under-drive gear set 104 are 1:1.4 and 1.4:1, respectively. Using a simple planetary or epicyclic gear set, for instance, having four planet gears and one ring gear, one can achieve gear ratios from 2:1 to 1:2 and in between. Coupling gears together and engaging one to the sun gear and the other to the ring gear provides a range of ratios to 100:1 and 1:100. This can change if a simple, compound, or reverted gear train is used.

A third, middle gear is achieved in an example embodiment by directly coupling the transmission input, e.g., the input disk 98, to the transmission output, e.g., the hub shell 92. This provides a direct drive gear; i.e., an output being driven by an input at a 1:1 gear ratio. Intermediate components can be provided between the transmission input and transmission output while the transmission input and transmission output are directly coupled, so long as the 1:1 gear ratio is provided.

The above gears are only examples, however. It is not necessary that one over-drive, one under-drive, and one direct drive gear ratio be provided in every embodiment. The example transmission 90 can be reconfigured, using techniques that will be appreciated by those of ordinary skill in the art, into any combination, including combinations of the following: one 1:1 gear ratio, one or more over-drive gear ratios, and zero under-drive gear ratios; one 1:1 gear ratio, one or more under-drive gear ratios, and zero over-drive gear ratios; one 1:1 gear ratio, one or more over-drive gear ratios, and one or more under-drive gear ratios; no 1:1 gear ratio, one or more over-drive gear ratios, and zero under-drive gear ratios; no 1:1 gear ratio, one or more under-drive gear ratios, and zero over-drive gear ratios; and no 1:1 gear ratio, one or more over-drive gear ratios, and one or more under-drive gear ratios.

Packaging moving parts of the transmission 90 inside the hub shell 92, and thus within the hub of the wheel 70, significantly reduces the threat of rust, dirt, and injury. In an example embodiment, the hub shell 92 is filled with grease, which helps to prevent wear and allows smooth operation.

Figure 9C:
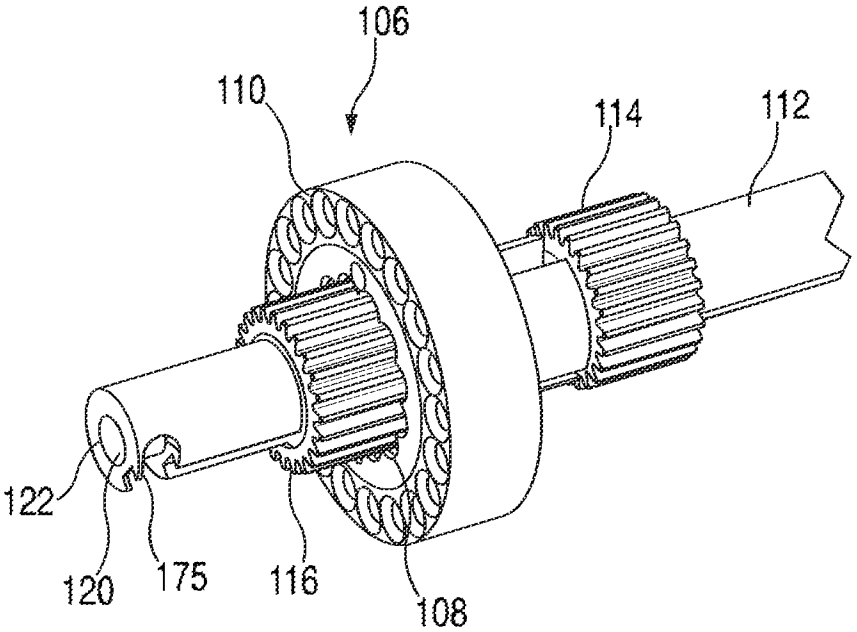
FIG. 9C is a perspective view of the shifter assembly of FIG. 9B.
Figure 9B:
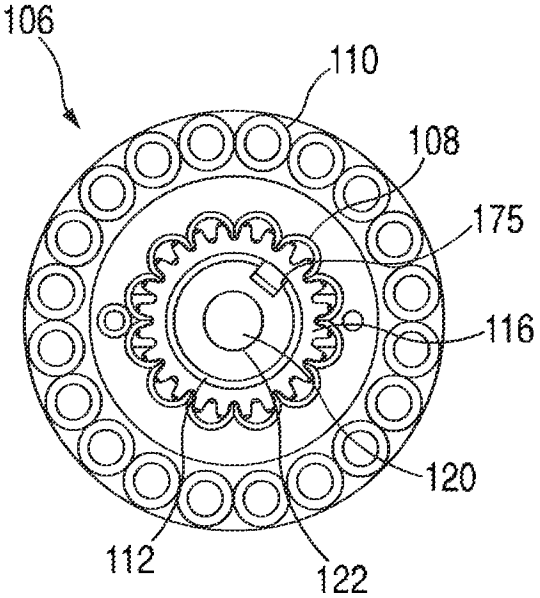
FIG. 9B is a plan view of a shifter assembly for the multiple-speed transmission of FIG. 9A, illustrating engagement of first or third gear.

In the example multiple-speed transmission 90, gears are physically selected by a selector that includes a shifter assembly 106, best viewed in FIGS. 9B-9C. FIGS. 9B-9C show how the shifter assembly 106, which slides along an axle (first axle) 112 centrally disposed inside the transmission 90, engages the over-drive gear set 102 and the under-drive gear set 104. The example shifter assembly 106 includes a clutch, for instance a set of right and left dog clutches 108 (only the left one is visible in FIG. 9B), for engaging a sun gear 116 for the over-drive gear set 102 or a sun gear 114 for the under-drive gear set 104. The shifter assembly 106 further includes a coupling 110 for engaging the hub shell 92 (the transmission input) and the input disk 98 (the transmission input). The coupling 110 is free to rotate with respect to the dog clutches 108. In another example embodiment, the clutch can be embodied in simple bars that fit onto a recessed area on each sun gear 114, or a shape that fits into a recessed area of the inside diameter of the sun gear. The coupling 110 may be, for instance, any shape (e.g., a simple shape) that fits into recessed areas of the transmission output and transmission input (or parts directly coupled thereto). Alternatively, it could have a simple recess into which the transmission output and transmission input fit.

Depending on the position of the shifter assembly 106 along the axle 112, the dog clutch 108 engages either set of planetary gears, or the coupling locks the input directly to the output. In the position shown in FIG. 9B, in which the shifter assembly 106 engages the sun gear (e.g., the sun gear 116), the coupling 110 is free to rotate about the axle 112. However, the dog clutch 108 locks the sun gear 116 by fitting over the sun gear. Accordingly, the dog clutch 108 is not free to rotate about the axle 112.

In an example embodiment three-speed transmission hub, the gear teeth for the sun gear 114, 116 are designed to have a 99% reliability in fatigue with a safety factor of 2 in response to a cyclic loading of a 9.0 Nm torque from the hand rim 94, which is the peak amount of torque applied during normal wheelchair propulsion. The gear teeth and all other torque transmitting components preferably have at least a safety factor of 2 to Von Mises stress in response to peak torques of 16.7 Nm when propelling up a ramp.

To selectively move the shifter assembly 106, the selector in an example embodiment further includes a shifter pinion 118 coupled, e.g., attached, to the shifter assembly 106. The shifter pinion 118 is coupled to a shifter rod 120 that extends at least partly out of the transmission 90 through the center 122 of the axle 112, as best viewed in FIGS. 9D-9F. The shifter rod 120, and thus the shifter pinion 118, can be moved back and forth axially in order to selectively change gears. In the example transmission 90, the shifter pinion 118 moves the shifter assembly 106 axially to one of three positions. The range of motion of the shifter pinion 118 is defined in an example embodiment by a length of a slot in which it rides. Sliding to the left (in the orientation shown in FIG. 9A and generally in the orientation shown in 9C-9E) results in engaging the over-drive gear set (third gear) with a 140% (1:1.4) gear ratio. Sliding to the right results in engaging the under-drive gear set (first gear) with a 71.4% (14:1) gear ratio, and sliding to the middle results in locking the input disk 98 directly to the hub shell 92 to achieve a 100% (1:1) direct drive gear ratio (gear 2).

Figure 9D:
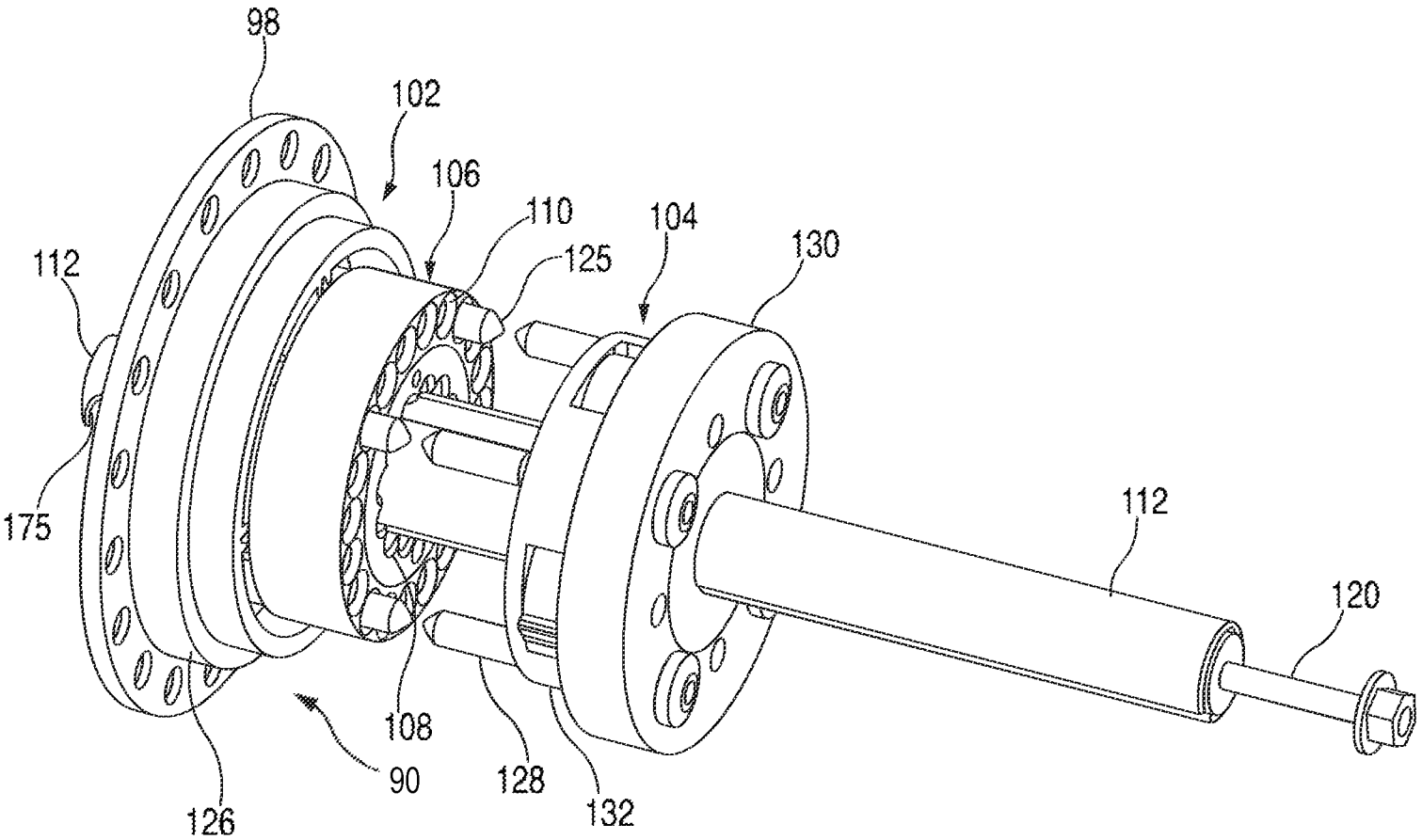
FIG. 9D-9I show operation of the multiple-speed transmission of FIG. 9A in states for third gear (FIGS. 9D-9E), second gear (FIGS. 9F-9G), and first gear (FIGS. 9H-9I), respectively.
Figure 9E:
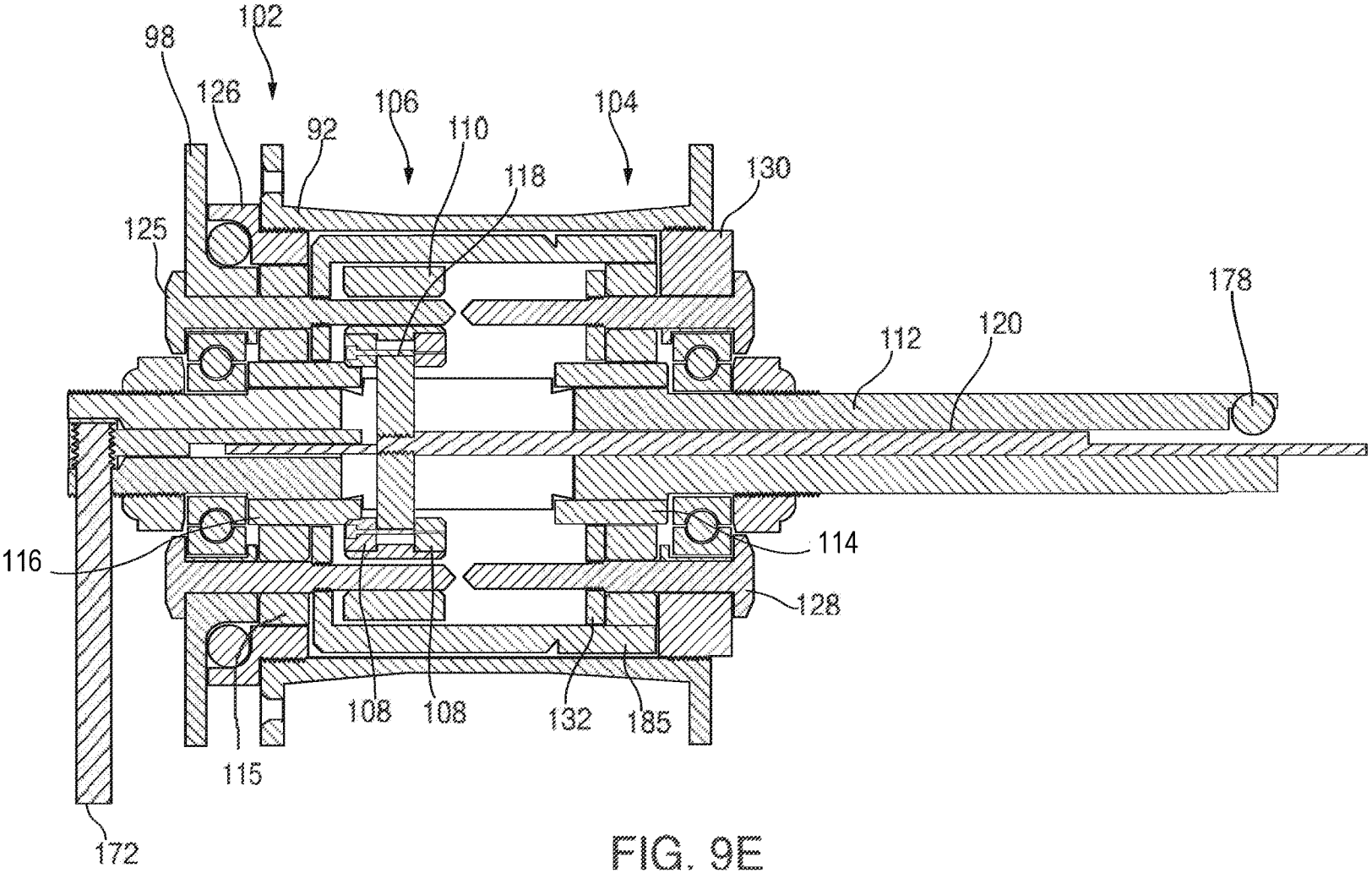
Figure 9F:
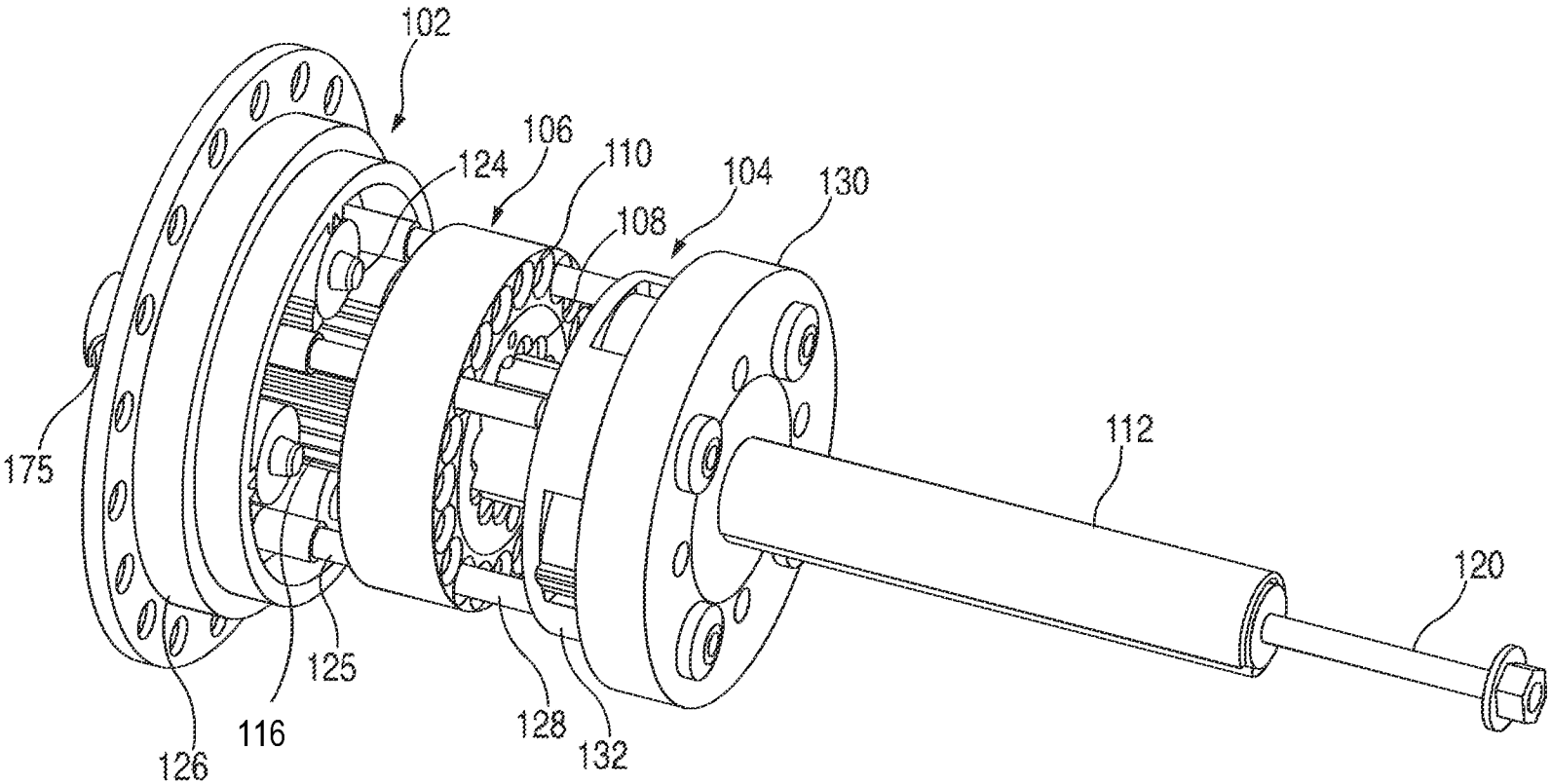
Figure 9G:
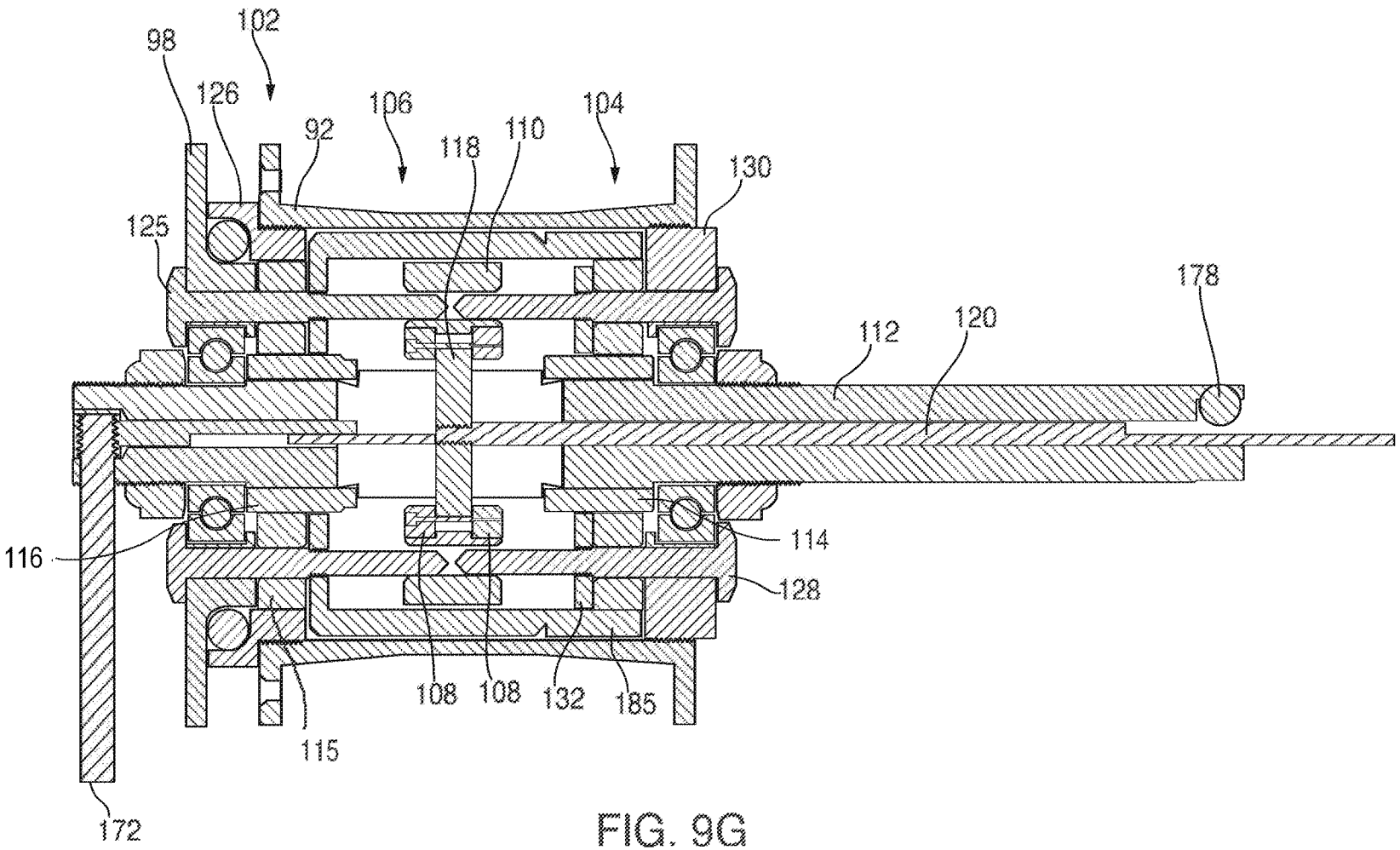
Figure 9H:
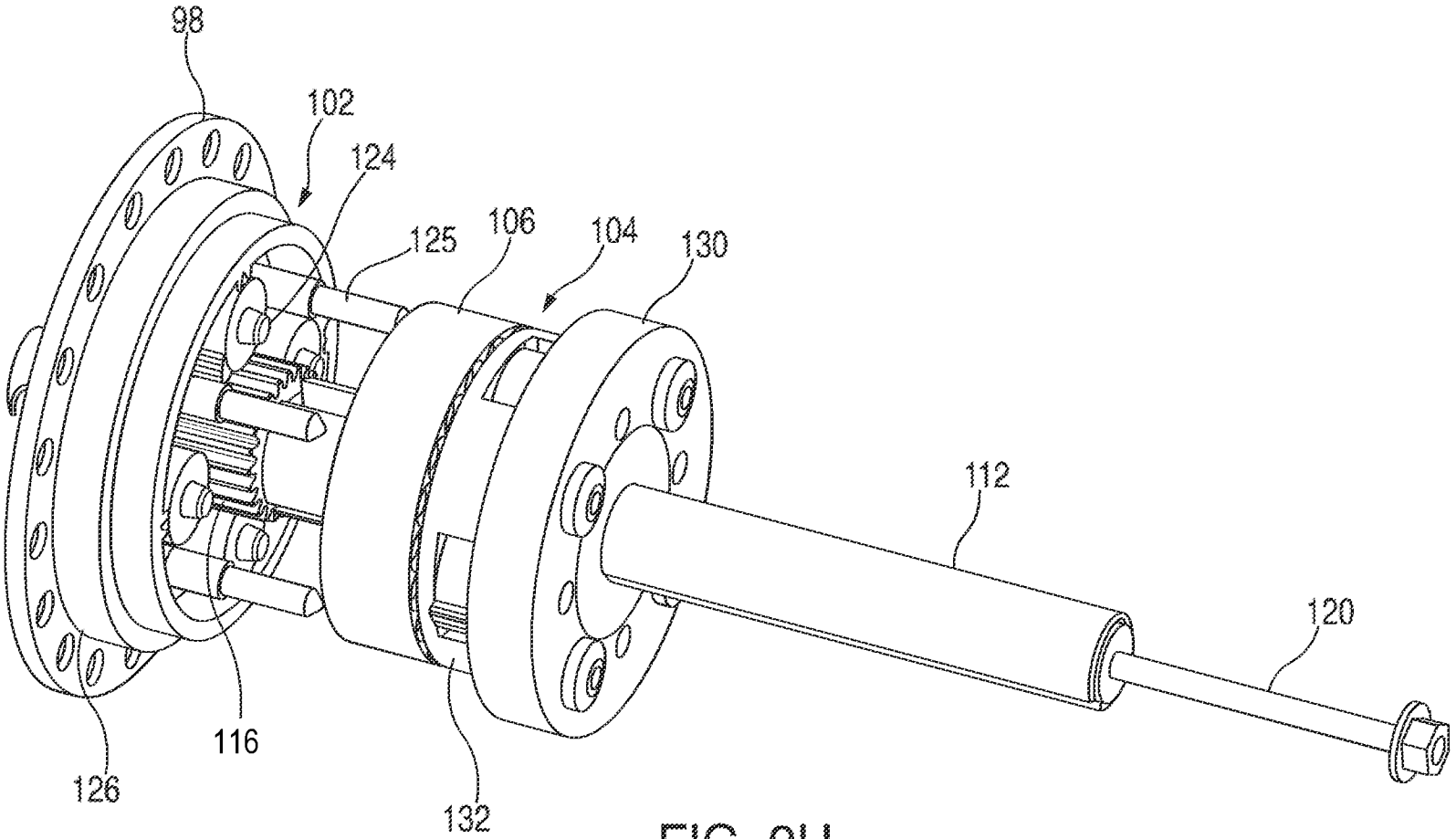
Figure 9I:
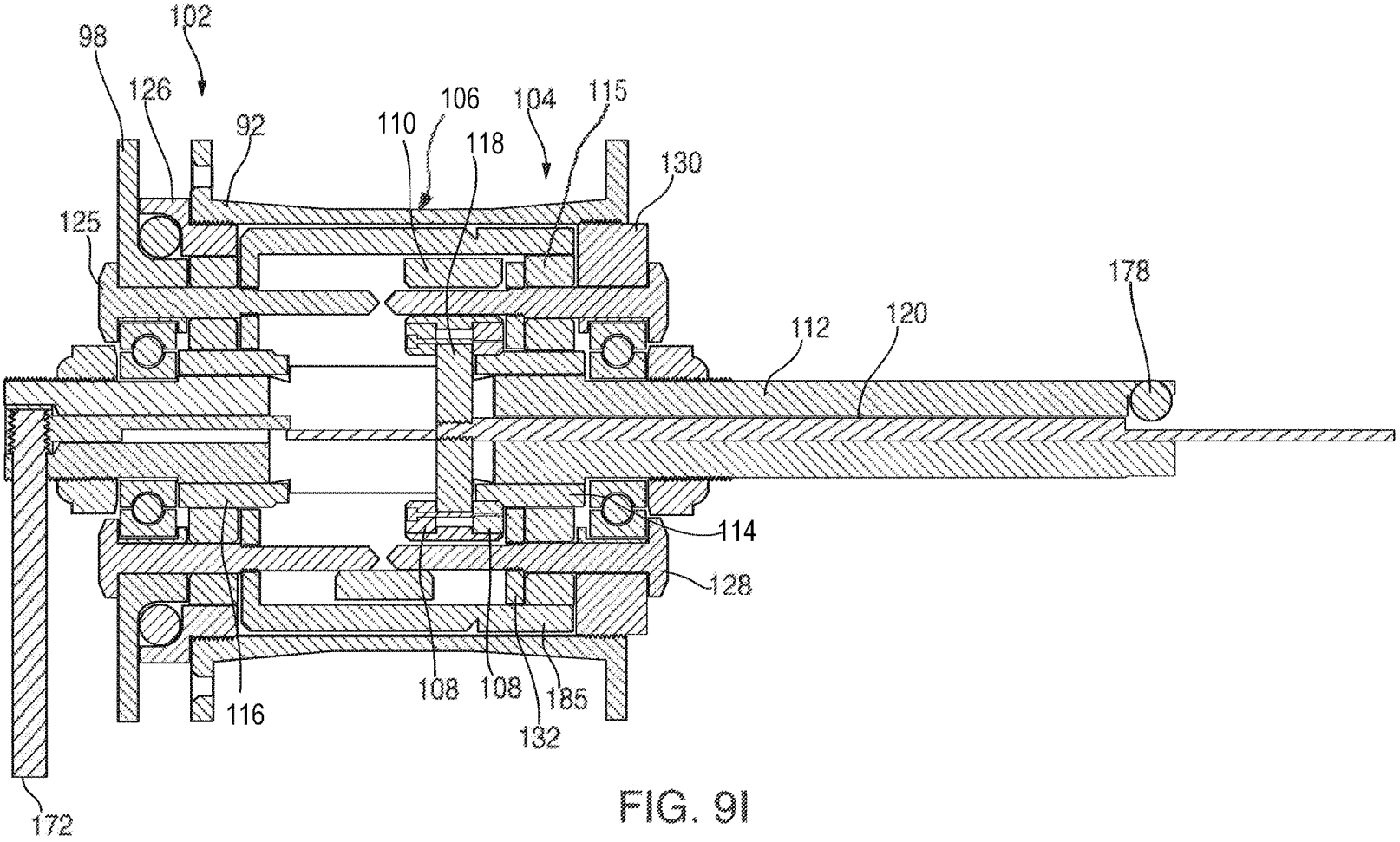

For example, FIGS. 9D, 9F, and 9H show the multiple speed transmission 90 with the hub shell 92 removed for clarity and in three respective states, as selected by movement of the shifter rod 120. FIGS. 9E, 9G, and 9I show a cutaway view of the multiple speed transmission 90 in the same three states. In the state shown in FIGS. 9D-E, the multiple speed transmission 90 is in third gear (1:1.4). The left dog clutch 108 engages the left (over-drive) sun gear 116. Further, the input disk 98 is coupled (e.g., connected) to a planet carrier 124, which carries the planet gears 115 of the over-drive gear set 102 by a set of inwardly extending coupling shafts 125 that extend through the over-drive gear set and through the coupling 110 on the shifting assembly 106. A ring gear 126 of the over-drive gear set is coupled (e.g., connected) to the hub shell 92 (not shown in FIG. 9D). When the left sun gear 114 is locked in this state, the ring gear 126, and thus the hub shell 92, can move faster than the input disk 98 coupled to the planet carrier 124.

FIGS. 9F-9G show a second state of the multiple speed transmission 90 in which the transmission is in second gear (direct drive). Here, both the coupling shafts 125 disposed on the input disk 98 and inwardly oriented coupling shafts 128 disposed on an output disk 130 engage opposing sides, respectively, of the coupling 110 of the shifter assembly 106. The output disk 130 is coupled (e.g., attached) to the planet carrier 132 of the under-drive gear set 104, such as by attachment via threads (not shown) on the coupling shafts 128, and is further directly coupled to the hub shell 92. This locks the coupling shafts 125, 128, and thus couples the input disk 98 directly to the hub shell 92, allowing a 1:1 gear ratio. The sun gears 114, 116 can rotate freely.

FIGS. 9H-9I show a first state of the multiple speed transmission 90 in which the transmission is in first gear (1.4:1), which state is substantially the opposite of the third gear state in FIG. 9D. Here, the coupling shafts 128 of the under-drive gear set 104 engage the coupling 110 of the shifter assembly 106, and the right dog clutch 108 engages and locks the right sun gear 114. The input disk 98 is coupled (e.g., connected) to the ring gear 185 of the under-drive gear set 104 through the planet carrier 124 of the overdrive gear set 102, and a planet carrier 132 of the under-drive gear set 104 is connected to the hub shell 92 through the output disk 130. This causes the hub shell 92 to move more slowly than the input disk 98.

The shifter rod 120 is driven by an actuator 134 such as but not limited to an electromechanical actuator. Referring again to FIG. 8, in an example embodiment, the electronics 72 disposed underneath the seat 80 of the wheelchair 78 include two actuators 134 (one for each hub), e.g., electromechanical actuators, and more particularly stepper motors, which move the shifter rods 120 of each transmission 90 and thus actuate the transmission to change the gear. A nonlimiting example linear actuator is model FA-35-S-12-1, Firgelli Automations; Ferndale, Wash.

Preferably, each shifter rod 120 is spring loaded to always push out. In this way, the actuators 134 can consistently connect to the shifter rods 120. Alternatively, an embodiment can include, as nonlimiting examples, any combination of the following: spring loaded shifter rods so that the shifter rod pushes outward or inward; electromechanical actuators which connect to the shifter rods with a screw system, spring loaded detents, or any other shape that couples the two together; electromechanical actuators which connect to the shifter rods with a cable that pulls the shifter rod against the direction that the spring loads the shifter rod; and electromechanical actuators which directly push the shifter rods against the direction that the spring loads the shifter rod.

The example actuators 134 are powered in an example embodiment by H-bridges (e.g., MC33887, Pololu Corporation; Las Vegas, Nev.) (not shown), or any other suitable circuits, including circuits having transistors and/or relays, and a power source. The actuators 134 are controlled by a suitably programmed controller 138. Nonlimiting example power sources include a 12 V rechargeable battery, and a particular example a lithium-ion battery, a nonlimiting example of which is a rechargeable 12V NiMH battery pack with 3500 mAh capacity (CHUN-100DC42, BatterySpace-.com; Richmond, Calif.). Rotary encoders or potentiometers, including linear potentiometers 136, can be provided to provide feedback on shifter rod position and intended gear. A nonlimiting example linear potentiometer is EWA-P12C15B14, Panasonic; Osaka, Japan. The actuators 134 can use the feedback to move to a specified location.

A nonlimiting example actuator 134 is not back-drivable, so when the electronics 72 power down, the transmission 90 for each wheel 70 may be locked in whatever gear it was were last in. However, other example actuators may be back-drivable. A (e.g., battery powered) monitoring system (not shown) can also be provided for shutting down the electronics 72 before a power source (e.g., battery) runs out. In such an embodiment, the wheelchair 78 can automatically stay in $2^{nd}$ gear (i.e., 1:1 gear ratio, or direct drive). In another example embodiment, springs (not shown) inside the hub 74 can be provided to allow the transmission 90 to always start in $2^{nd}$ gear upon power-up, such as at the start of the day or upon reattachment of the wheel 70 after removal for transport. This also gives a useful zero reference for the controller. Additionally, example embodiments can include a generator or dynamo mounted to the wheel of the wheelchair in a suitable manner in order to recharge the batteries via the motion of the wheelchair itself.

Position control of the example actuators in an example embodiment is provided by the controller 138, which in a more particular example embodiment is a simple proportional-derivative (PD) controller implemented in a microcontroller. A nonlimiting example controller 138 is ATmega328, Atmel, Corp.; San Jose, Calif. Another example controller 138 is a TI MSP430 microcontroller (Texas Instruments, Dallas, Tex.). In an example embodiment the controller 138 is powered by the same power source as the actuators 134, though separate power sources (e.g., batteries) could also be used. Feedback devices, such as but not limited to the linear potentiometer 136, provide feedback signals to the controller 138 for positioning the actuator 134.

The example controller 138 also serves to select the optimal gear. In an example embodiment, the controller 138 does this by reading sensor measurements for angular velocity of each wheel 70 (speed sensor), input torque of each wheel (torque sensor), and wheelchair 78 inclination (tilt). In an example embodiment, a speed sensor can be provided by a rotary encoder such as but not limited to a magnet attached to the wheel 70 and a Hall effect sensor (e.g., MP101301, Cherry Corp; Pleasant Prairie, Wisconsin) on the body, e.g, the frame 76, of the wheelchair 78. A single axis accelerometer (e.g., MMA1270EG, Freescale Semiconductor; Austin, Texas), can be mounted on the wheelchair frame 76 to sense the incline of the wheelchair to determine if maneuvering on level, inclined, or declined terrain. Torque can be sensed by a strain gauge or pressure sensitive resistor on one of the spokes of the hand rim. In the example embodiment, a strain gauge is located on the spokes of the hand rim 100, and an accelerometer is located underneath the seat. The resistor signal can be transmitted to the microcontroller via a slip ring or wireless transmitter.

Figure 10:
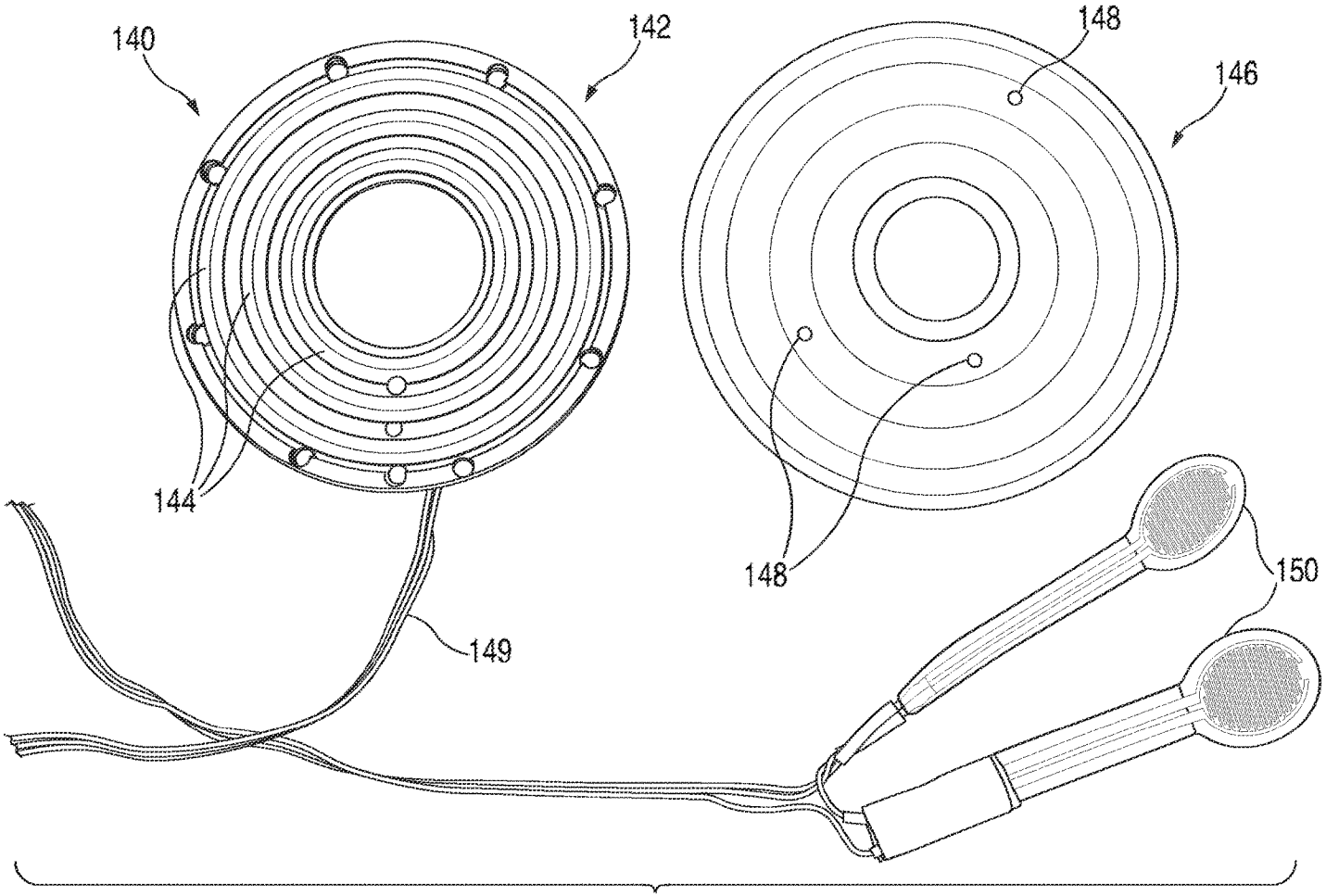
FIG. 10 shows an example slip ring for torque sensors.
Figure 11:
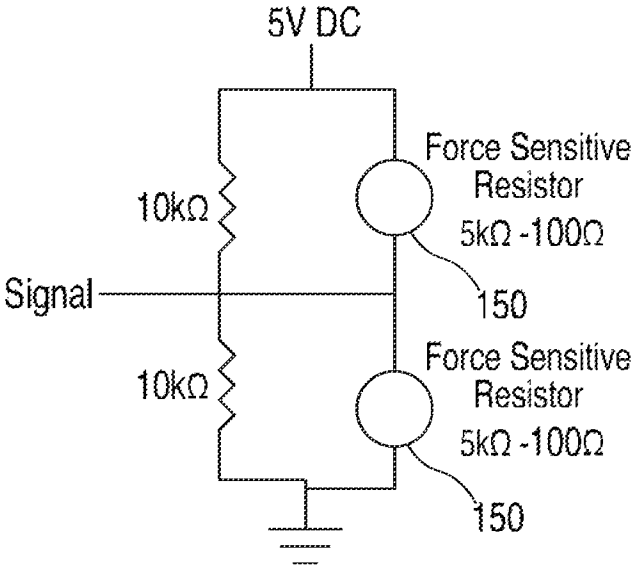
FIG. 11 is an example force sensitive resistor circuit diagram for torque sensors.

For example, FIG. 10 shows an example pancake style slip ring 140, including a copper milled slip ring plate 142 having three tracks 144 (power, signal, and ground) and a disk 146 holding three contacts 148 that are disposed to slide along tracks in a circuit board (not shown) coupled to the (relatively stationary) controller 138. The tracks 144 are coupled via suitable leads 149 to force sensitive resistors 150 that can be disposed on the rotating hand rim 94 for sensing torque. The force sensitive resistors 150 can be wired in a half bridge configuration, as shown by example, in FIG. 11. The force sensitive resistors 150 modulate the signal proportionally to the torque applied to the hand rim 94. The signal from the force sensitive resistors 150 can be passed through the slip ring 140 to the controller 138. In the example circuit shown in FIG. 11, each force sensitive resistor is located on one side of the bolt connecting the hand rim spokes 100 to the hand rim 94. The example signal will vary from 2.5 V+−2.5 V depending on the sign of the instantaneous torque. The strain gauge is used to infer direction and approximate amplitude of the input torque from which output torque is derived by dividing by the current gear ratio.

However, it will be appreciated that the speed, torque, and/or tilt sensors could be provided by other devices and/or other configurations. For example, the tilt could also be sensed by a combination of a rate gyro and/or an accelerometer or inclinometer. The torque could also be sensed with a load cell put in line with the force. The speed could also be sensed with a tacho-generator, rotary encoder or a laser tachometer.

The example controller 138 can select the best gear ratio using a suitably programmed algorithm, which in an example embodiment is based on (a constant times the negative of the torque) plus (a different constant times the speed of the wheelchair); that is:

$$GR=-K_1T+K_2S+K_3$$

In this equation, GR is the gear ratio, $K_1$, $K_2$, and $K_3$ are constants, T is torque, and S is speed. These constants can be derived experimentally, for instance. When the wheelchair user is not pushing the wheelchair 78, the tilt can be used in the same example algorithm to approximate the amount of torque needed to maintain speed. The example algorithm preferably also only allows the wheelchair to be shifted when the user is not touching the hand rims. This means that shifting will occur in the ~500 ms between pushes so that the user preferably does not notice the change. Because the wheels 70 in an example embodiment are controlled by a single controller 138, they will not be in two different gears. However, in another example embodiment the wheels 70 are controlled by separate controllers. An example controller 138 receives inputs from three sensors.

Figure 12:
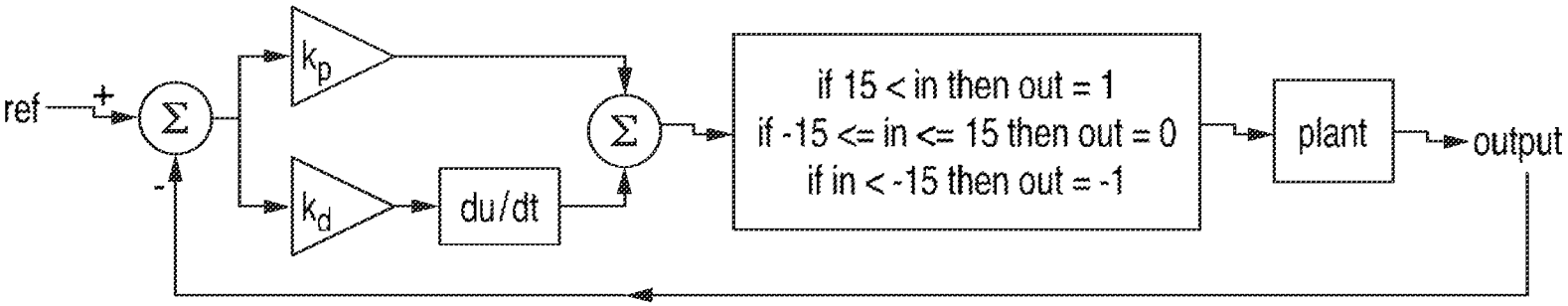
FIG. 12 shows an example bang-bang (on or off) proportional derivative (PD) controller for actuators.

Similar to a manual transmission in a car, torque is momentarily released in order to shift gears. In an example embodiment, this is accomplished during the time between pushes; i.e., the recovery phase. An additional signal processing algorithm can be provided to keep the wheelchair 78 from changing gears too often by imposing a minimum amount of time (e.g., number of seconds) that the wheelchair has to stay in one gear before changing again. This gear shifting can be controlled by a bang-bang (forward, off, or reverse) proportional derivative (PD) control algorithm running on the controller 138 at, e.g., 100 Hz, such as the controller algorithm shown in FIG. 12. The example controller 138 works by first computing the error signal as the output signal subtracted from the reference (ref) signal. The control effort is computed by multiplying the reference signal by the proportional gain ($K_r$) and adding it to the time derivative (du/dt) of the error signal multiplied by the derivative gain ($K_d$). The plant, in this case receives a forward (1), off (0), or reverse (−1) signal by passing the control effort through the nonlinear block. The gains of the controller 138 can be heuristically tuned, including testing proportional and derivative gains ($K_r$, $K_d$) by experimentation to minimize overshoot and settling time.

| Peak Output Torque of the Most Recent Push (N-m) | Desired Gear (1st, 2nd, or 3rd) | | | | | | | | | |
|---|---|---|---|---|---|---|---|---|---|---|
| 18 | 1 | 1 | 1 | 1 | 1 | 1 | 1 | 2 | 2 | 2 |
| 16 | 1 | 1 | 1 | 1 | 1 | 1 | 2 | 2 | 2 | 2 |
| 14 | 1 | 1 | 1 | 1 | 1 | 2 | 2 | 2 | 2 | 2 |
| 12 | 1 | 1 | 1 | 1 | 2 | 2 | 2 | 2 | 2 | 3 |
| 10 | 1 | 1 | 1 | 1 | 2 | 2 | 2 | 2 | 3 | 3 |
| 8 | 1 | 1 | 1 | 2 | 2 | 2 | 2 | 3 | 3 | 3 |
| 6 | 1 | 1 | 1 | 2 | 2 | 2 | 2 | 3 | 3 | 3 |
| 4 | 1 | 1 | 2 | 2 | 2 | 2 | 2 | 3 | 3 | 3 |
| 2 | 1 | 1 | 2 | 2 | 2 | 2 | 3 | 3 | 3 | 3 |
| 0 | 1 | 1 | 2 | 2 | 2 | 2 | 3 | 3 | 3 | 3 |
| | 0.0 | 0.5 | 1.0 | 1.5 | 2.0 | 2.5 | 3.0 | 3.5 | 4.0 | 4.5 |

Instantaneous Output Velocity (m/s)

The above table displays an example basic gear selection map based on the peak output torque of the most recent push and the instantaneous output velocity. When the wheelchair 78 is not moving, it is not possible to know the peak cycle torque that is required for propulsion, so the sensed incline (e.g., via the tilt sensor) is used in an example embodiment to predict the amount of torque required and select the best gear, e.g., when starting from a stopped position when going uphill.

For safety concerns, in normal wheelchairs braking is accomplished by grabbing the hand rims and using friction from the user's hands to slow the wheelchair. An example embodiment allows this to be accomplished in the same way, and the added gear ratios allow this task to become easier. When pushing up an incline, a wheelchair user has to fight against gravity, often causing the wheelchair to roll backwards. While in low gear using an example embodiment, it takes less torque to prevent this. If a regular wheelchair is rolling forwards down a hill, there is a slight possibility that the hand rims could be moving too fast to grab onto in order to achieve a controlled descent. With the example system, in high gear, the hand rims 94 move more slowly, which makes controlling the wheelchair 78 easier in this scenario. Additionally, if the example system were to malfunction mechanically, lose electrical power, or have a wheel 70 removed for loading in the car, springs inside the hub 74 in an example embodiment can be configured to force the shifter pinion 118 back into $2^{nd}$ gear, direct drive, which causes it to function as a normal everyday wheelchair. These design features help provide a safe and effective device for transportation for a wheelchair user.

Figure 13:
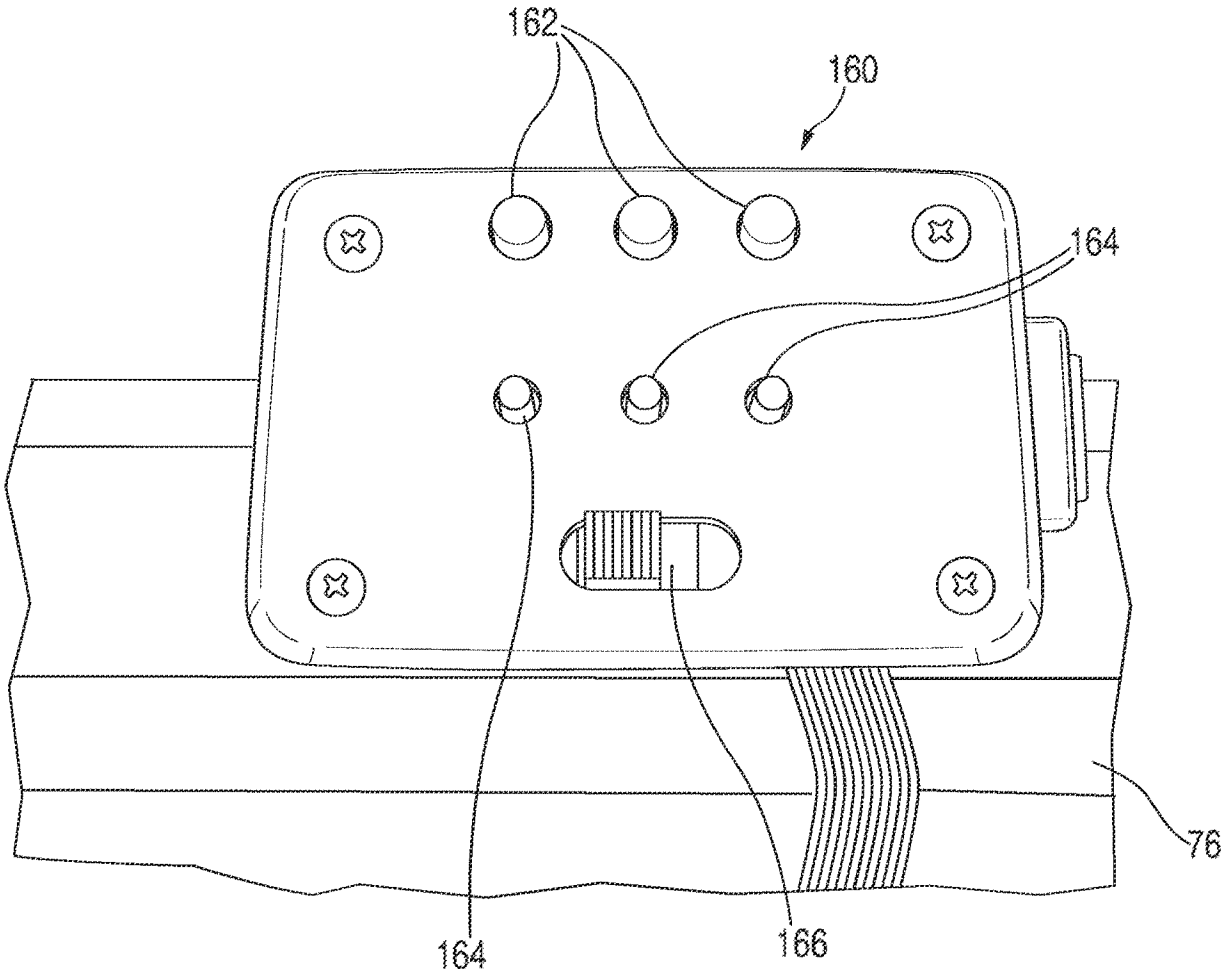
FIG. 13 shows an example user interface.

An example system also includes a user interface 160, shown by example in FIG. 13. The example user interface 160 includes gear indicators 162 (e.g., LED lights), which displays the current gear to the user. Disposed below the gear indicators 162 for each gear are manual gear selectors 164 for allowing a user to manually select a desired gear. Also provided is a selector switch 166 for allowing the user to manually override the gear selection and enter manual mode. In an example embodiment, in manual mode, the user can select the desired gear using the manual gear selectors 164. When in automatic mode, the controller 138 automatically selects the gear without user input. The gear indicators 162 can be configured to indicate the current gear selection for one or both modes. A switch can also be provided to completely power down the system and leave it in $2^{nd}$ gear (i.e., 1:1 gear ratio, the same as a conventional manual wheelchair). The user interface 160 can include other features, such as but not limited to a power meter to monitor the battery and a screen to display the currently selected gear.

In another example embodiment, a manual transmission is provided by, for instance, coupling the shifter rod(s) 120 to a manual controller for actuation. Nonlimiting examples of manual, user-operable controls include a lever (not shown) that can be manipulated by the user. Couplings include but are not limited to levers, cams, gears, fluid coupling, electromechanical couplings, etc. It is also contemplated that a powered actuator(s) can be provided for actuating the shifter rod 120, and this powered actuator can be manually controlled by a user, such as by manipulating manual controls (e.g., buttons). Such manual controls can also be connected to the controller 138 for operating the actuator(s), such as the manual mode described above, and the user interface 160 can be used to aid a user in determining when/whether to change gears.

Weight is a significant concern with wheelchair users. Ultralight wheelchairs have been shown to increase the efficiency of wheelchair propulsion. A significant feature of an embodiment add-on system is that it is lightweight. Preferred add-on systems are less than 10 lbs. For a 120 lb wheelchair user on a 15 lb ultra-light wheelchair, this amounts to a 7.4% increase in overall weight. However, other embodiment add-on systems can be greater than 10 lbs. To minimize the weight of the inventive system, it is contemplated to use lighter materials for the components (e.g., aluminum).

Battery life can be increased by using smaller motors, larger batteries, and/or smarter control. As a nonlimiting example, the battery life can be extended by limiting the amount of shifts over a certain period of time (e.g., one minute).

A low weight is very useful, for instance, when loading a wheelchair into a car. To do this, the wheelchair user removes the release wheels from the wheelchair, and lifts each wheel separately and finally the frame. The weight of an embodiment add-on system is distributed substantially evenly, with approximately one-third of the additional weight in each wheel 70 with the hub 74, and one-third of the additional weight on the wheelchair frame 76 with the electronics 72. This makes lifting the wheelchair 78 with an embodiment add-on system only slightly more difficult than a normal wheelchair.

Figure 14:
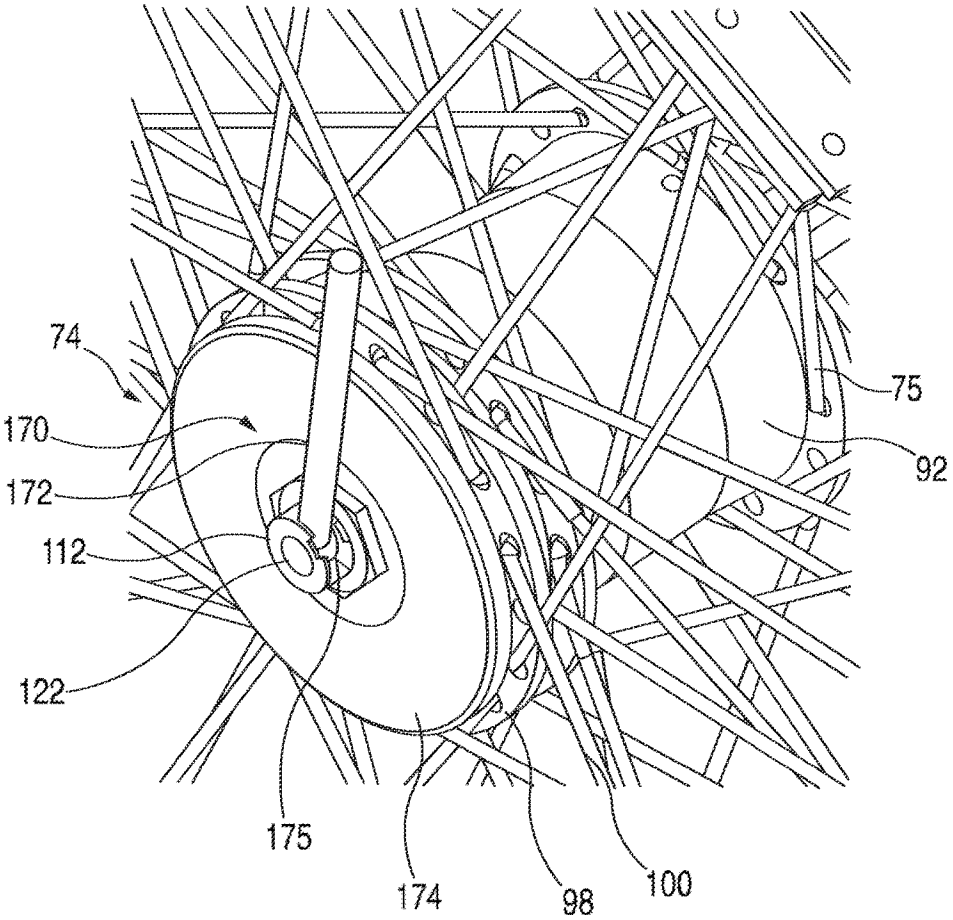
FIG. 14 shows a portion of the wheelchair wheel of FIG. 6, indicating a lever for a quick release locking assembly according to an embodiment.
Figure 15:
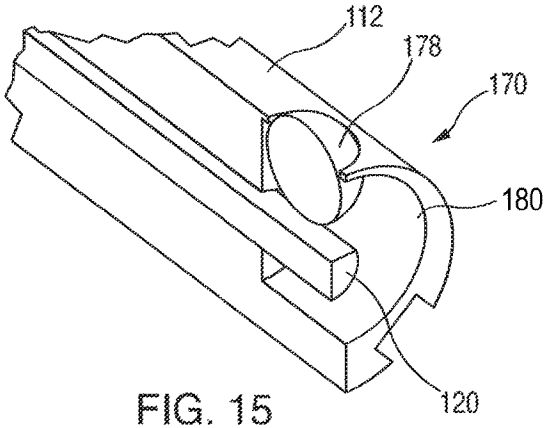
FIG. 15 shows a cutaway portion of the transmission axle of FIG. 9A, including a cam surface and ball bearing for the quick release locking assembly.

Oftentimes removal of the wheels 70 is done with only one hand. In an example embodiment, a user can attach and detach the wheels 70 from the wheelchair 78 quickly and without the use of tools via a quick release locking mechanism 170. FIGS. 14-15 illustrate the example quick release locking mechanism (locking mechanism) 170 for the wheelchair wheel 70. The example locking mechanism 170 allows removal and attachment of the wheels 70 from the wheelchair 78 without requiring tools This example locking mechanism 170 includes a lever 172 disposed on an outside end 174 of the hub 74. The axle 112 is configured to accept the example locking mechanism.

The lever 172 is fixedly coupled to the shifter rod 120 via an opening 175 so that turning the lever rotates the shifter rod ninety degrees (for example). As shown in the FIG. 15, the shifter rod 120 has a small, flat cam surface, and the shifter rod runs through the center of the axle 112. When the cam surface turns, it pushes a small ball bearing 178 into and out of a hole 180 in the axle. When the ball bearing 178 protrudes from the hole 180, the axle 112 cannot slide free from the wheelchair frame 76. On the other hand, when the cam surface is in the position shown in FIG. 15, the ball bearing 178 can retract into the axle 112, which allows the axle 112 to slide freely in and out of the wheelchair frame 76.

In an example embodiment, after initial installation of the electronics 72 and mounting brackets 179 (FIG. 16) (e.g., using suitable tools), to release each wheel 70 from the wheelchair 78, the user turns the lever 172 on the outside of the wheel ninety degrees. When the user turns the lever 172 in the opposite direction, the cam surface causes the ball bearing 178 to protrude from the axle 112 in a way such that it will prevent the axle from sliding in and out of the wheelchair frame 76, effectively locking the wheel 70 onto the wheelchair 78.

Figure 16:
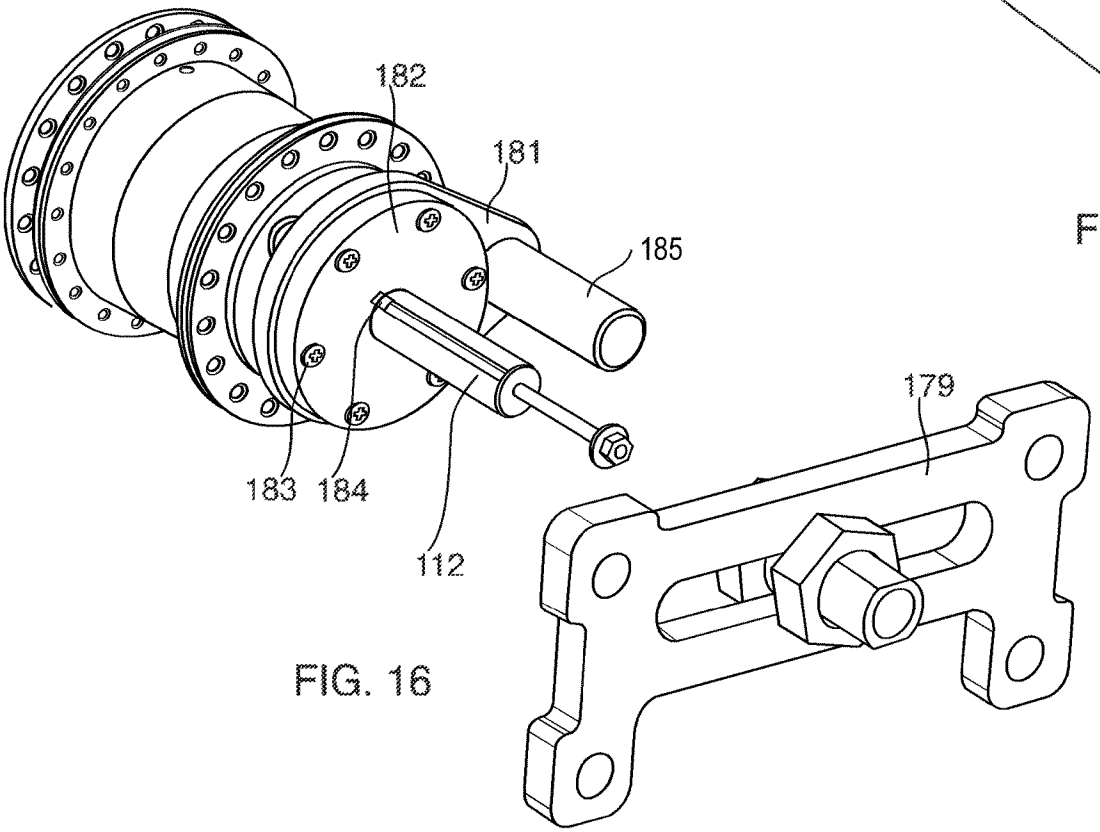
FIG. 16 is a perspective view of the hub of FIG. 6, further showing a second axle and a mounting bracket for installing an example transmission.

In an example embodiment, the axle of the 3-speed hub is mounted into a bracket 179 so that it cannot rotate with respect to the frame 76 of the wheelchair 78 as shown in FIG. 16. A nonlimiting way of preventing the axle from rotating is to couple it to a second axle 185 which inserts into the mounting bracket 179. The second axle 185 is coupled to the first axle 112 through a bracket 181 which is coupled to a keyed shaft collar 182 by a plurality of fasteners, e.g., screws 183. The keyed shaft collar 182 fits over the first axle 112 and is prevented from rotating by a length of key stock 184 which fits in the keyway of the first axle 112 and the keyway of the shaft collar.

As stated above, though particular example wheelchairs 78 are described and shown herein, the present invention is not to be limited to a particular brand or type of wheelchair. For instance, while particular examples are shown for a wheelchair such as a Quicki TI wheelchair, an example can be provided for other types or brands of wheelchairs by, for instance, adding a bracket that prevents the axle of the wheel from rotating, holds the controller, and holds the actuators which shift the gears.

An embodiment automatic transmission can provide wheelchair users with a more energy efficient way of travel in everyday life. By keeping the method of self propulsion and steering identical (or substantially identical) to a standard design in an example embodiment, users can make an easy transition to an inventive device from a standard manual wheelchair. This eliminates the learning curve.

Similarly to the way that people ride bicycles, gear shifting can make traveling up and down hills, over long distances, and over rough terrain all more ergonomically efficient. An example system provides a similar advantage to wheelchair users automatically by intelligently sensing how they are using the wheelchair and selecting the best gear for on-the-fly operation. Thus, an example system can provide an easier way of pushing a manual wheelchair without asking the user to give up independence and rely on large motors and batteries. Further, example systems of the present invention may reduce the severity and incidence of shoulder pain.

In contrast to motor driven wheelchairs in the art, a wheelchair fitted with an example system does not have a range that is greatly limited by battery life (though some example controllers may include batteries that eventually need to be changed or recharged). A particular, nonlimiting example system weighs only 10-15 lbs., has more than two gears (e.g., three or more), and does not require a learning curve to begin using it and benefitting from it. In contrast to lever operated wheelchairs, an example embodiment retains the standard hand rim method of controlling the wheelchair. An example automatic transmission can be operated without requiring extra thought from the user for operation.

With manual gear shifting, the fact that the user has to stop and shift manually limits its benefits. For example, when approaching an incline, it is mechanically inefficient to stop at the bottom of a hill. It is preferred to let the body and chair's inertia carry the user upward. With an example embodiment, by contrast, the user can continue to roll onto a ramp without stopping. The controller can shift to low gear just as it starts to get difficult to push. Other examples include shifting to a lower gear when transitioning to carpet, grass, sand, gravel, etc.

This is also analogous to the way that people ride bicycles. When riding up a hill or at lower speeds, the rider shifts to a lower gear to get more torque. When riding down a hill or at a faster speed, the rider shifts to a higher gear to make maintaining the speed easier. In order to gain this same mechanical advantage in wheelchairs, an example shifting system is automatic, because a user's hands are occupied with pushing the hand rims. Nonlimiting example users can include manual wheelchair users (mWCUs) who are low-mid and mid-high functioning. This group is mostly independent and active, experiences moderate difficulty pushing a wheelchair, and can appreciate how automatic gear shifting as with embodiments of the present invention can benefit their day-to-day life. However, low and high functioning users could also benefit. Example devices can address a very pressing problem experienced by mWCUs, pain.

While various embodiments of the present invention have been shown and described, it should be understood that other modifications, substitutions, and alternatives are apparent to one of ordinary skill in the art. Such modifications, substitutions, and alternatives can be made without departing from the spirit and scope of the invention, which should be determined from the appended claims.

Various features of the invention are set forth in the appended claims.

What is claimed is:

1. An apparatus for driving a manually-powered wheelchair, wherein the wheelchair comprises a frame, a first wheel, and a second wheel, wherein each of the first wheel and the second wheel comprises a hand rim and a drive wheel, wherein each of the first wheel and the second wheel is configured to be rotatably coupled to the frame, wherein the apparatus comprises:

the first wheel and the second wheel of the wheelchair, wherein each of the first wheel and the second wheel comprises a multiple speed transmission coupled to the respective first wheel and the second wheel, wherein each, multiple speed transmission comprises:

a transmission output coupled to the respective drive wheel;

a transmission input coupled to the respective hand rim, such that each of the respective drive wheel and the respective hand rim of the first and second wheel rotate concentrically with one another but can rotate at different speeds;

wherein each multiple speed transmission for the first wheel and the second wheel comprises at least two gears selectively coupling the respective transmission output to the respective transmission input of each of the respective multiple speed transmissions for the first wheel and the second wheel;

wherein the at least two gears of each of the respective multiple speed transmissions being taken from a group consisting of one or more of an over-drive gear, one or more of an under-drive gear, and a direct drive gear directly coupling the respective transmission input to the respective transmission output of each of the respective multiple speed transmissions; and wherein the apparatus further comprises a controller for selecting one of the at least two gears from at least one of the multiple speed transmissions of the first wheel and the second wheel to operate the selected multiple speed transmissions of the selected first wheel and second wheel;

wherein the apparatus further comprises one or more sensors coupled to at least one of the first wheel and the second wheel for sensing position and torque of the respective first wheel and second wheel;

wherein the controller is configured to receive signals from the one or more sensors and automatically selects the respective one of the at least two gears from the respective at least one multiple speed transmission for the first wheel and the second wheel based on the signals to operate selected multiple speed transmission of the first wheel and the second wheel; and wherein the apparatus further comprises a tilt sensor coupled to the frame for measuring tilt of the wheelchair;

wherein said controller further receives a signal from the tilt sensor and selects the respective one of the at least two gears from the selected multiple speed transmission of the first wheel and the second wheel further based on the received signal from the tilt sensor.

2. The apparatus of claim 1, wherein, each multiple speed transmission for the first wheel and the second wheel comprises the respective ,transmission output of the respective multiple speed transmission coupled to a portion of a housing that houses the respective transmission input and the respective at least two gears of the respective multiple speed transmission.

3. The apparatus of claim 2, wherein each of the multiple speed transmission housing comprises a housing for a hub disposed within the first wheel and the second wheel.

4. The apparatus of claim 1, wherein each multiple speed transmission for the first wheel and the second wheel further comprises a selector, wherein the selector comprises:

a shifter assembly that selectively couples the respective transmission input and the respective transmission output of the respective multiple speed transmission, via one of the respective at least two gears; and a shifter rod coupled to the shifter assembly for selectively positioning the shifter assembly.

5. The apparatus of claim 4, wherein each of the respective at least two gears of the respective multiple speed transmission for the first wheel and the second wheel comprises an over-drive gear, and wherein the shifter assembly is configured to couple at least one of the respective transmission input and the respective transmission output to the respective over-drive gear.

6. The apparatus of claim 4, wherein each of the respective at least two gears comprises an under-drive gear and an over-drive gear, and wherein the shifter assembly is configured to couple the respective transmission input to the respective over-drive gear and to couple the respective transmission output to the respective under-drive gear.

7. The apparatus of claim 4, wherein said shifter assembly comprises:

a coupling configured for directly coupling the respective transmission input and the respective transmission output; and at least one clutch for engaging at least one of the respective under-drive gear and the respective over-drive gear.

8. The apparatus of claim 1, wherein each multiple transmission for the first wheel and the second wheel further comprises a selector, wherein the selector comprises:

a shifter assembly that selectively couples the respective transmission input and the respective transmission output of the respective multiple speed transmission via one of the respective at least two gears, wherein the shifter assembly is linearly movable along an axle; and a shifter rod coupled to the shifter assembly for selectively linearly positioning the shifter assembly; and wherein an actuator selectively moves the shifter rod linearly to position the shifter assembly.

9. The apparatus of claim 1, further comprising:

a user interface comprising indicia for displaying a current gear to a user;

said user interface further comprising at least one selectively operable control for manually selecting the gear of the respective at least two gears.

10. The apparatus of claim 1, wherein, each multiple speed transmission for the first wheel and the second wheel comprises the respective transmission output coupled to a portion of a housing that houses the respective transmission input of the respective multiple speed transmission, the respective at least two gears, and includes a selector;

wherein each of the multiple speed transmission housings comprise a housing for a hub disposed within the first wheel and the second wheel; and wherein the controller comprises a user-operable control coupled to one of the respective at least two gears by a coupling taken from a group consisting of levers, cams, gears, fluid coupling, and an electromechanical coupling.

11. The apparatus of claim 1, further comprising:

a locking mechanism coupled to the respective multiple speed transmission for decoupling one of the first wheel and the second wheel from the frame of the wheelchair.

12. The apparatus of claim 11, further comprising:

a shifter assembly that selectively couples the respective transmission input and the respective transmission output of the respective multiple speed transmissions, via one of the respective at least two gears, the shifter assembly being linearly movable along an axle; and a shifter rod coupled to the shifter assembly for selectively linearly positioning the shifter assembly; and wherein the locking mechanism of the respective multiple speed transmission comprises:

a ball bearing disposed within the axle and selectively movable to a hole within the axle to lock or unlock the axle with respect to the frame;

a cam surface of said shifter rod, wherein the cam surface is disposed within the axle to engage the ball bearing to move the ball bearing into and out of the hole; and a lever coupled to the shifter rod to selectively rotate the shifter rod;

wherein rotation of the shifter rod causes the cam surface to engage the ball bearing and move the ball bearing into and out of the hole.

13. An apparatus for driving a manually-powered wheelchair, the wheelchair comprising a frame having a first wheel and a second wheel, wherein each of the first wheel and second wheel of the wheelchair comprises a hand rim and a drive wheel, wherein each of the first wheel and second wheel is configured to be rotatably coupled to the frame, wherein the apparatus comprises:

the first wheel and the second wheel of the wheelchair, wherein each of the first and second wheel comprises an automatic multiple speed transmission coupled to the respective first wheel and second wheel of the wheelchair;

where each automatic multiple speed transmission for the first wheel and the second wheel is configured as a continuously-variable, transmission comprising:

one or more sensors coupled to the respective wheel for sensing a position of the respective continuously-variable transmission and/or speed and/or torque of the respective wheel;

a transmission output coupled to the respective drive wheel of the respective wheel;

a transmission input coupled to the respective hand rim of the respective wheel, such that the respective drive wheel and the hand rim of the respective wheel rotate about a common axis but can rotate at different speeds;

wherein each continuously-variable transmission of each automatic multiple speed transmission is coupled to the respective transmission output and the respective transmission input for selectively coupling the respective transmission output and the respective transmission input wherein each of the continuously-variable transmission include a servo controlling a position of a roller of the respective continuously-variable transmission; and a controller for shifting the respective continuously-variable transmission of the first wheel and the second wheel based on the sensed position of the respective servo to operate the respective automatic multiple speed transmission for the first wheel and the second wheel;

wherein the respective transmission output of the respective continuously-variable transmission comprises a first cone that rotates with the respective drive wheel of the respective first wheel and the second wheel, and wherein the respective transmission input from the respective continuously-variable transmission comprises a second cone that rotates with the respective hand rim.

14. The apparatus of claim 13, wherein the respective continuously-variable transmission of the first wheel and the second wheel comprises the respective roller that selectively engages a surface of the respective first cone and a surface of the respective second cone;

wherein the apparatus further comprises an actuator coupled to the respective roller of the respective continuously-variable transmission of the first wheel and the second wheel to select an angle of the respective roller with respect to the respective first cone and the associated second cone.

* * * * *